US006278407B1

(12) United States Patent
Ashjaee et al.

(10) Patent No.: US 6,278,407 B1
(45) Date of Patent: Aug. 21, 2001

(54) DUAL-FREQUENCY CHOKE-RING GROUND PLANES

(75) Inventors: Javad Ashjaee, Saratoga, CA (US); Vladimir S. Filippov, Moscow (RU); Dmitry V. Tatarnikov, Moscow (RU); Andrej V. Astakhov, Moscow (RU); Igor V. Sutjagin, Moscow (RU)

(73) Assignee: Topcon Positioning Systems, Inc., San Jose, CA (US)

( * ) Notice: Subject to any disclaimer, the term of this patent is extended or adjusted under 35 U.S.C. 154(b) by 0 days.

(21) Appl. No.: 09/255,932

(22) Filed: Feb. 23, 1999

Related U.S. Application Data

(60) Provisional application No. 60/075,820, filed on Feb. 24, 1998.

(51) Int. Cl.[7] ..... H01Q 1/38

(52) U.S. Cl. ..... 343/700 MS; 343/785; 343/848

(58) Field of Search ..... 343/700 MS, 846, 343/848, 785, 786, 756, 909

(56) References Cited

U.S. PATENT DOCUMENTS

| | | | | |
|---|---|---|---|---|
| 3,434,146 | * | 3/1969 | Petrich | 343/785 |
| 4,536,767 | * | 8/1985 | Rembold et al. | 343/786 |
| 4,819,004 | * | 4/1989 | Argintaru et al. | 343/786 |
| 6,040,805 | * | 3/2000 | Huynh et al. | 343/785 |

OTHER PUBLICATIONS

James M. Tranquilla, J. P. Carr, Hussian M. Al–Rizzo, "Analysis of a Choke Ring Groundplane for Multipath Control in Global Positioning System (GPS) Applications," *IEEE Transactions on Antennas and Propagation,* vol. AP–42, No. 7, Jul. 1994, pp. 905–911.

P. Clarricoats, P. Saha "Propagation and Radiation Behavior of Corrugated Feeds, Part 2—Corrugated Conical–Horn–Feed", Proceedings of the IEE, vol. 118, No. 9, pp. 1177–1186, Sep. 1971.

J. N. Pheld, L. S. Benenson, *Antennas and Feeding Devices,* Part 2, Air Force Engineering Academy, Moscow, 1959, pp. 100–107 (in Russian); English translation attached.

T. Hekmat, et al., "Integrated GPS/GLONASS Antenna for High Performance Applications", ION GPS–95 Meeting, Sep. 12–15, 1995, pp. 845–851.

* cited by examiner

*Primary Examiner*—Tan Ho
(74) *Attorney, Agent, or Firm*—Coudert Brothers

(57) ABSTRACT

Choke-ring ground planes are commonly used for multipath rejection in geodetic surveying systems. Such ground planes consist of a thick metal disc with deep grooves on one of the flat surfaces. An antenna is mounted in the center of the grooved surface. Known ground planes used in dual frequency communication systems (L1 and L2) could not be constructed to have good rejection of multipath signals in both L1 and L2 frequencies; instead, they are constructed for good rejection of multipath signals in L2 but not good for the rejection of multipath signals in L1. A first invention provides for equally good multipath rejection for both L1 and L2 frequencies by incorporating novel electromagnetic filter structures within the choke-ring grooves. The filter structures of the present invention enable the choke ring to provide multipath rejection in each frequency band which is as good as, or better than, the multipath rejection achieved in the L2 band with existing devices. A second invention provides for groove depths which are less than one-quarter wavelength of the frequency which has the longer wavelength (e.g., the L2 frequency in the GPS system). The shorter groove depth of the second invention provides better multipath rejection for the L2. Both inventions may be used together to improve multipath rejection for both L1 and L2 bands. A third invention of the application relates to methods of constructing choke ring ground planes which may be applied to the other inventions disclosed herein as well as existing prior art ground planes and future ground planes.

65 Claims, 13 Drawing Sheets

FIG._5
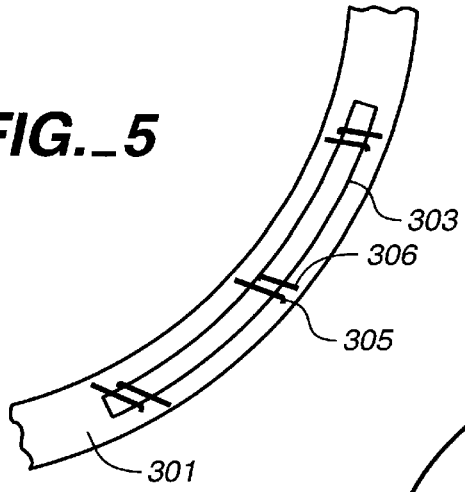
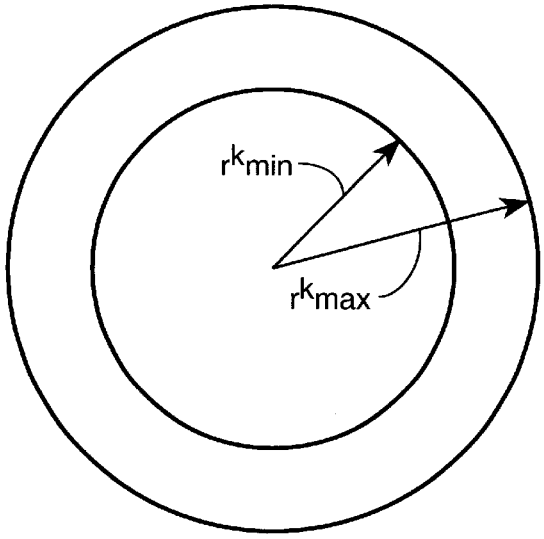
FIG._6A
FIG._6B
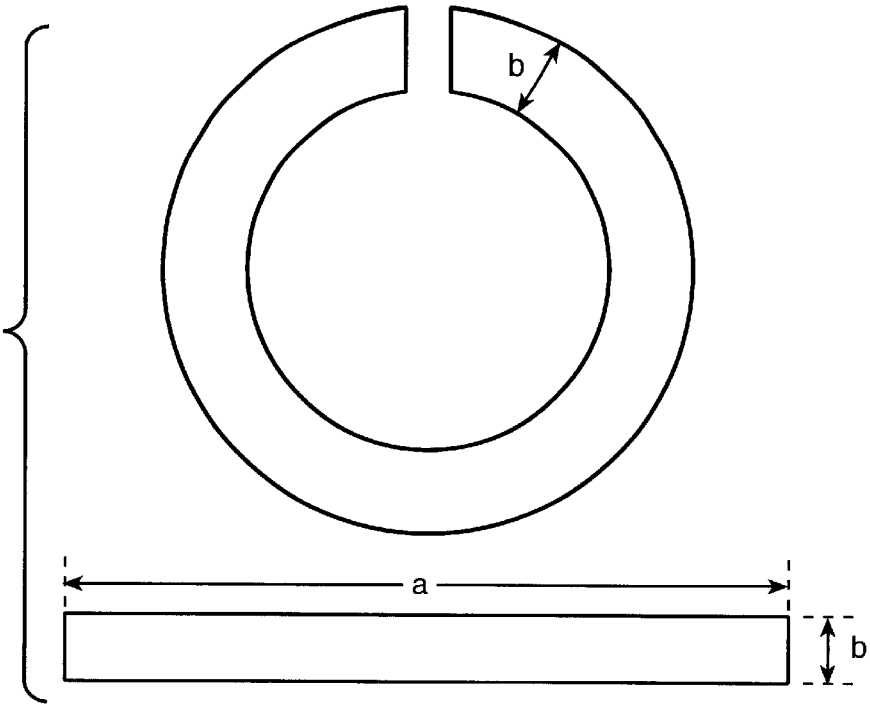

FIG._10A
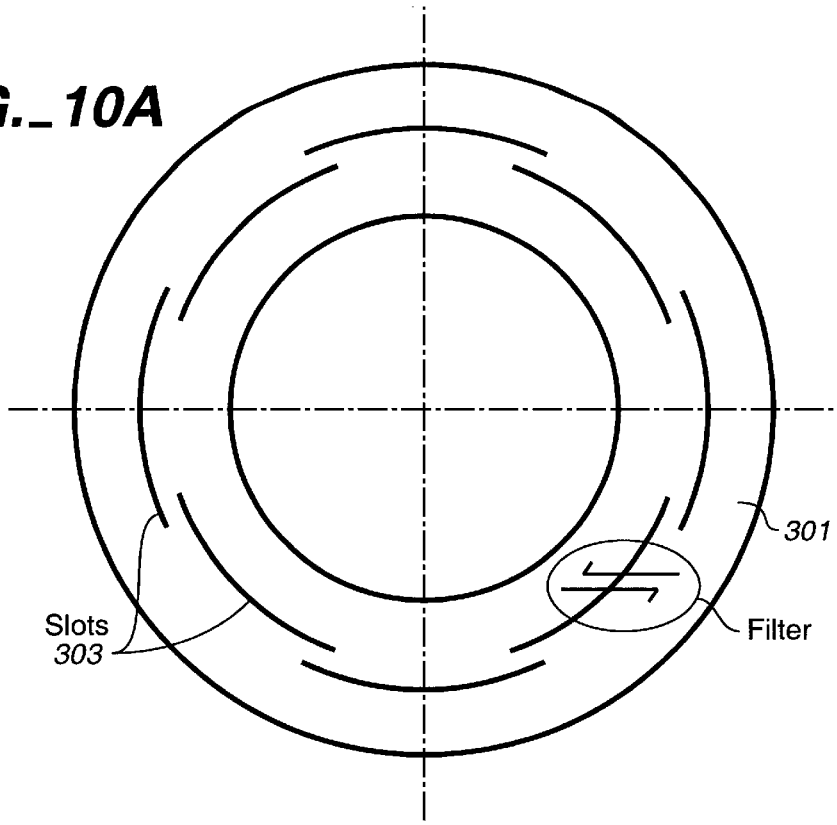
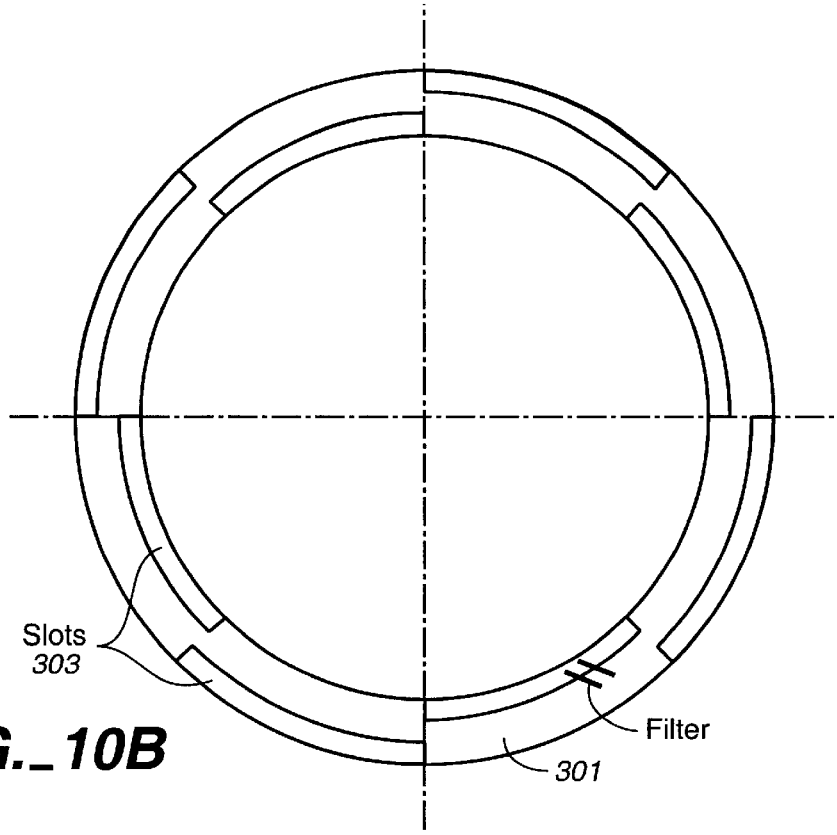
FIG._10B

DUAL-FREQUENCY CHOKE-RING GROUND PLANES

CROSS-REFERENCE TO RELATED APPLICATIONS

This application claims the benefit of U.S. Provisional Application Ser. No. 60/075,820 filed Feb. 24, 1998.

FIELD OF THE INVENTIONS

The present inventions relate to choke-ring ground planes for multipath rejection in dual frequency geodetic surveying systems and global positioning systems.

BACKGROUND OF THE INVENTIONS

Dual frequency antenna receiving systems are of particular interest for global positioning satellite (GPS) systems, which use signals in two different frequency bands, L1 and L2, with wavelengths corresponding to 19 cm and 24.4. cm, respectively. However, a problem with such systems is that the satellite signal reflects off of the earth's surface, producing a reflected signal that can interfere with the primary signal directly received by the antenna. Choke structures are one technique that can be used to increase the ability of the antenna to reject multipath signals.

Several constructions of choke-ring ground planes for multipath rejection in dual frequency systems are known to the art. Common single wavelength choke structures use a series of grooves with a depth equal to slightly more than one-quarter of the wavelength of the signal. If the antenna is to process signals in both L1 and L2 bands, the longer wavelength (L2) is used to set the depth of the grooves. Part of the reflected signal couples into the groove. The round trip path length through each groove is one-half of a wavelength, corresponding to a 180 degree phase inversion. These phase inverted signals of each of the grooves combine together and cancel part of the reflected wave, leading to improved antenna performance of the primary signal.

But in known designs, it is not possible to select a groove depth which provides the best multipath rejection for both of the GPS L1 and L2 frequencies. That is why usually the groove depth is chosen to provide the best rejection for the L2 band, at the expense of the L1 band. The best groove depth for L1 is approximately 30% less than the best depth for L2. Conventional thinking of the prior art teaches that decreasing the groove depth will cause deterioration of multipath rejection for the L2 band because of the appearance of a surface wave above the ground plane when the depth becomes much less than the quarter of the wavelength of L2. Therefore, in all existing choke-ring ground planes, the multipath rejection is much better for the L2 signals than it is for the L1 signals. This is why all the known choke-ring ground planes can be referred to as "single-frequency" ground planes.

T. Hekmat, et al., "Integrated GPS/GLONASS Antenna for High Performance Applications", ION GPS-95 Meeting, Sep. 12–15, 1995, discloses a choke-ring ground plane with two systems of grooves. The groove depth of one system is a little bigger then a quarter of wavelength of the L2 signal, and the groove depth of the second system is a little bigger then a quarter of wavelength of the L1 signal. But no performance characteristics were provided by the reference, so the effectiveness of this construction is not known.

As described in the Hekmet reference, other prior art constructions are based on a horn with corrugated walls. As it follows from the theory of the corrugated walls, the corrugation groove depth has to be bigger than a quarter of wavelength of the L2 signal in order to avoid the appearance of the surface wave above the ground plane, and therefore to avoid the deterioration of multipath rejection. However, this does not improve the multipath rejection for the L1 signals.

Accordingly, there is a need in the art to provide antenna systems which can receive signals in two (or more) bands, such as L1 and L2, while providing comparable multipath rejection for each of the bands. There is also need to improve the multipath rejection characteristics of antenna systems in each of the bands.

SUMMARY OF THE INVENTIONS

A first invention of the present application incorporates a novel electromagnetic filter structure within the choke-ring grooves which makes the depth of each groove appear to be different for each of the L1 and L2 signals. The L2 signals have the longer wavelength. The construction enables the choke ring to achieve the best multipath rejection for both L1 and L2 bands simultaneously. In a preferred embodiment of this invention, the grooves have a depth of approximately one-quarter wavelength of the L2 signal, and an intermediate ground plane is placed within the grooves at a depth which is typically within a range of approximately one-quarter wavelength of the L1 signal to approximately one-fifth wavelength of the L1 signal. A plurality of apertures, or slots, are formed in the intermediate ground plane. The apertures are constructed to pass the L2 signal and to reflect the L1 signal. The intermediate ground plane acts as the electrical ground plane for the L1 signals, whereas the bottom ground plane acts as the electrical ground plane for the L2 signals. In this way, both the L1 and L2 signals see a depth which is close to their respective quarter wavelengths. The selective transmission of the L2 signals and the reflection of the L1 signals by the apertures may be accomplished by an electromagnetic filter positioned near (e.g., over) each aperture.

A second invention of the present application, which may be used with the first invention or separate from the first invention, uses a groove depth for the L2 signals which is less than a quarter-wavelength of the L2 frequency (but which is greater than a quarter- wavelength of the L1 frequency). The second invention is contrary to the prior art, which teaches that the groove depth must be greater than one-quarter of a wavelength of the L2 frequency. Better multipath-rejection performance is obtained for the L2 signals. The second invention may also be applied to choke-ring ground planes which are designed for the better reception of L1 signals at the expense of the reception of the L2 signals. In this case, the groove depth is less than a quarter-wavelength of the L1 frequency.

When the first and second inventions are used together, the grooves have a depth of slightly less than one-quarter wavelength of the L2 signal, and the intermediate ground plane is typically placed within the grooves at a depth which is not more than one-quarter wavelength of the L1 signal.

A third invention relates to methods of constructing choke ring ground planes according to the present invention and the prior art, and a fourth invention relates to the choke ring ground plane so constructed.

DESCRIPTION OF THE DRAWINGS

FIG. 5 shows a fourth embodiment of the filter construction according to the first invention.

FIGS. 6A–6B are top views of a choke-ring groove as a coaxial waveguide, according to the analysis approach of the first invention;

FIG. 6A shows circular cross-section dimensions;

FIG. 6B shows a progressive transformation to a rectangular waveguide with linear dimensions provided by the latter depiction in FIG. 6B.

FIG. 9A shows a perspective view of the partial (Floquett) waveguide,

FIG. 9B shows a cross-sectional view of the waveguide without an aperture; and FIG. 9C shows a cross-sectional view of the waveguide with an aperture.

FIG. 10A is a top plan view of a second generalized method of arranging slot apertures according to the first invention; two subsystems of slots at respective radii from the center point of the ground plane are shown.

FIG. 10B is a top plan view of a third generalized method of arranging slot apertures according to the first invention; two subsystems of slots at respective radii from the center point of the ground plane are shown.

DETAILED DESCRIPTION OF THE PREFERRED EMBODIMENTS

Figure 1:
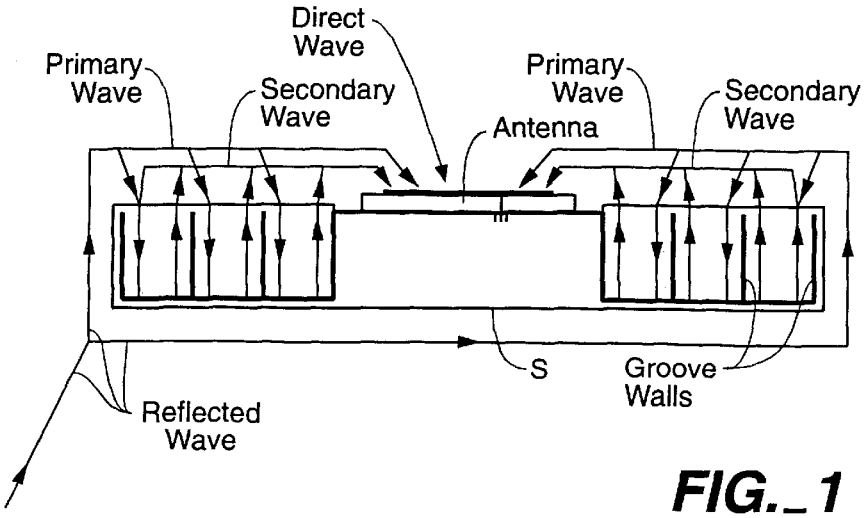
FIG. 1 (PRIOR ART)
FIG. 1 is a schematic view of the wave propagation in the vicinity of the ground plane according to the prior art.

FIG. 1 shows a schematic cross-sectional view of wave propagation in the vicinity of a choke-ring ground plane according to the prior art. The choke-ring ground plane may be viewed as a thick circular disk having a relatively large amount of thickness. FIG. 1 shows a cross-sectional view of the ground plane and antenna taken along the diameter of the ground plane. The vertical dimension of the ground plane is the thickness of the disk, and the horizontal dimension is the diameter of the disk. The ground plane has three concentric grooves formed in the top surface of the disk. Each groove has a depth which almost extends to the bottom of the disk.

An antenna is mounted in the center of the ground plane. The antenna receives the direct satellite signal, as well as a multipath signal that is generated by a reflection of the direct signal from the Earth's surface.

In terms of receiving the direct satellite signal, the impact of a choke-ring ground plane on the direct signal is only of concern for low elevation angles near the horizon direction. For these angles, the ground-plane causes a decrease in the antenna gain. For other directions in the upper semi-sphere above the horizon, the impact on the antenna gain for the direct satellite signal is small, and the choke-ring ground plane acts substantially like a flat ground surface.

The main purpose of the choke-ring ground plane is to prevent the electromagnetic waves reflected from the Earth surface from reaching the antenna element at the center of the choke-ring ground plane. These reflected waves are the multipath signals, As it follows from electromagnetic diffraction theory, the electromagnetic field of the reflected signal in the vicinity of the choke-ring ground plane can be viewed as the sum of two field waves. We call the first of these field waves the "primary wave," and it surrounds the ground plane along an imaginary conductive surface "S" (shown in FIG. 1) formed around the major surfaces of the choke-ring ground plane. The "primary wave" is the same as the reflected wave in flat ground planes. The primary wave originates as a reflected wave from the Earth's surface. It propagates toward the choke-ring, hits the choke-ring at the bottom surface and/or side surface of the ring, and then follows conductive surface S to the antenna element. The primary wave may travel by two or more routes on surface S to the antenna element. At some point, each of these routes passes over the grooves.

Before describing the second general field wave, we would like to further define the shape of imaginary conductive surface S. Surface S is a closed surface which covers that same surface area of the thick circular disk, but without the grooves formed in the disk. In other words, surface S has a bottom surface which coincides with the bottom surface of the choke-ring, a side surface which coincides with the side surface of the choke ring, and a top surface which is flat and lies just above the top edges of the grooves. Surface S does not go into the grooves.

The second field wave is created by the electromagnetic fields in the grooves. We call this wave the "secondary wave".

The electromagnetic fields in each groove can be viewed as the sum of two waves (FIG. 1). The first of these waves is caused by the primary wave passing over the groove, and it propagates from the top edges of the groove towards the bottom of the groove. The second wave in the groove propagates from the bottom towards the groove's open end (top edges). The first wave is excited by the primary wave, mentioned above, and the second wave is a field that is reflected by the groove's bottom. The second wave from each of the grooves combine together to generate the secondary wave.

The secondary wave, like the primary wave, propagates along the ground plane towards the antenna and contributes to the total signal received by the antenna, including the direct signal from the satellite. The objective of the choke-ring ground plane is for the primary wave and the secondary wave of the reflected multipath signal to substantially cancel each other at the antenna, to thereby leave the direct signal as the dominant one received by the antenna.

The phase relationship between the primary and secondary waves at the antenna depends on the difference in path lengths that each wave travels. This path difference is twice the depth of the grooves. The amplitude ratio of the primary wave to the secondary wave depends on the characteristics of the antenna element, its location on the ground plane, the width, and the number of grooves, etc. These dependencies are well known to the art.

If the amplitude of the primary and secondary waves are equal, and if the phase difference between them is 180 degrees, then these two waves generated by the reflected multipath signal will cancel each other at the antenna, and the multipath signal will be suppressed. If the amplitudes are not equal, or if the phase shift is slightly different from 180 degrees, the primary and secondary waves will cancel by some amount, and the multipath signal will still be suppressed, but not as much as when the amplitudes are equal and the phase difference is 180 degrees. However, total suppression of the multipath signal is not always necessary, and the ground plane still provides a useful function even if it does not provide complete suppression.

In fact, for a given choke-ring ground plane, the complete suppression of the multipath signal occurs only for certain elevation angles between the antenna and the Satellite, and for the other angles the multipath is partially suppressed. The maximum suppression usually occurs for angles that are close to the zenith, and minimal suppression occurs at angles close to the horizon.

It follows from the above description that the groove depth has to be approximately equal to $\lambda/4$, where $\lambda$ is the wavelength of the multipath signal. If it is less than this distance, the creation of an additional surface wave becomes possible. According to the teaching of the prior art, this additional surface wave propagates along the grooves structure if the depth is smaller than $\lambda/4$, and it can destroy the desired phase and amplitude ratios between primary and secondary waves. For these reasons, the additional surface wave is presently viewed in the art as being undesirable, and the prior art choke-ring ground planes use groove depths which are a little bigger than $\lambda/4$ in order to suppress the generation of this additional surface wave. As it is known to those skilled in the art, this limitation follows from the theory of large-area groove structures, which are big compared with the wavelength of the signal (i.e., structures which contain large numbers of grooves). The above-stated limitation is rigorously true for structures that occupy the entire infinite plane. The inventors have discovered that for choke ring ground plane with just a few grooves (usually 3), much better performance can be obtained if the groove depth is a little smaller than a quarter of the signal's wavelength, usually between approximately 88% of the signal's quarter wavelength up to approximately 98% of the signal's quarter wavelength. This is the above-mentioned second invention of the present disclosure. An exemplary embodiment of a choke-ring ground plane using the second invention is shown in greater detail by FIG. 11, which provides exemplary dimensions.

Therefore, the groove depth depends on the wavelength $\lambda$ of the signal that is intended to be received by the antenna and processed by the receiver, and can be selected for the intended frequency to be received and processed. Enhanced performance is generally found in the range between approximately 88% of $\lambda/4$ and approximately 98% of $\lambda/4$, and more preferably in the range of between approximately $0.92\cdot\lambda/4$ and approximately $0.97\cdot\lambda/4$. These ranges are provided for choke rings having three or more grooves, with each groove having a width of between approximately 20 mm to approximately 24 mm, and with the innermost groove having an inner diameter of 190 mm±40 mm. For the L2-band signal, which has a wavelength of 24.4 cm, the range of approximately 88% of $\lambda/4$ to approximately 98% of $\lambda/4$ corresponds to approximately 54 mm to approximately 60 mm. For the L1-band signal, which has a wavelength of 19 cm, the range of approximately 88% of $\lambda/4$ to approximately 98% of $\lambda/4$ corresponds to approximately 41.5 mm to approximately 46.5 mm (herein the term "approximately" means+0.5 mm), Usually, the antenna element is placed in a recess formed at the center of the choke ring. Typical values of recess range between approximately 20 mm to approximately 27 mm for the range of groove dimensions provided above. The depth of this recess will generally affect the best choice of the groove depth in the range of 88% and 98% of $\lambda/4$, and this may be found by one of ordinary skill in the art without undue experimentation. In preferred constructed embodiments, the inventors have used a recess of 20 mm. Unless otherwise specified herein, the use of the term "approximately" in qualifying a whole number is intended to encompass the values which are closest to the whole number specified. For example, the range of approximately 20 mm to approximately 24 mm encompasses the range 19.5 to 24.5.

Figure 2A:
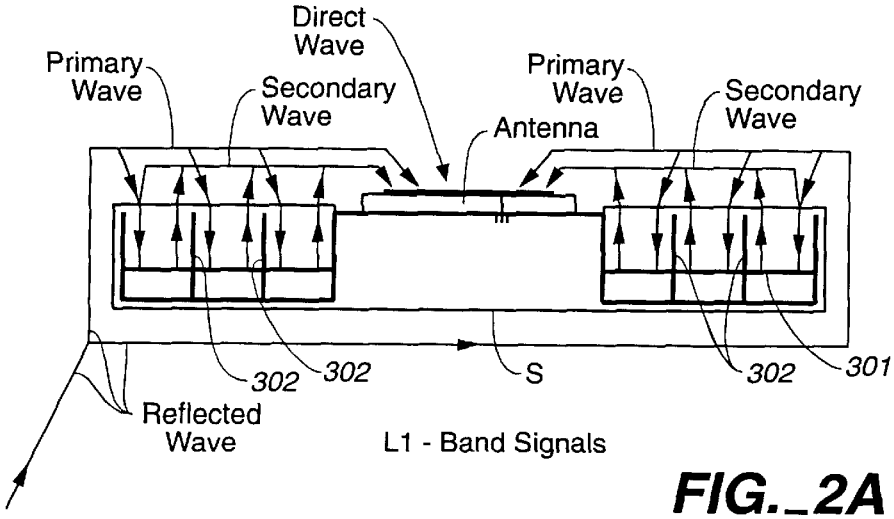
FIG. 2A is a schematic view of the wave propagation of an L1 signal in a ground plane structure according to the first invention.
Figure 2B:
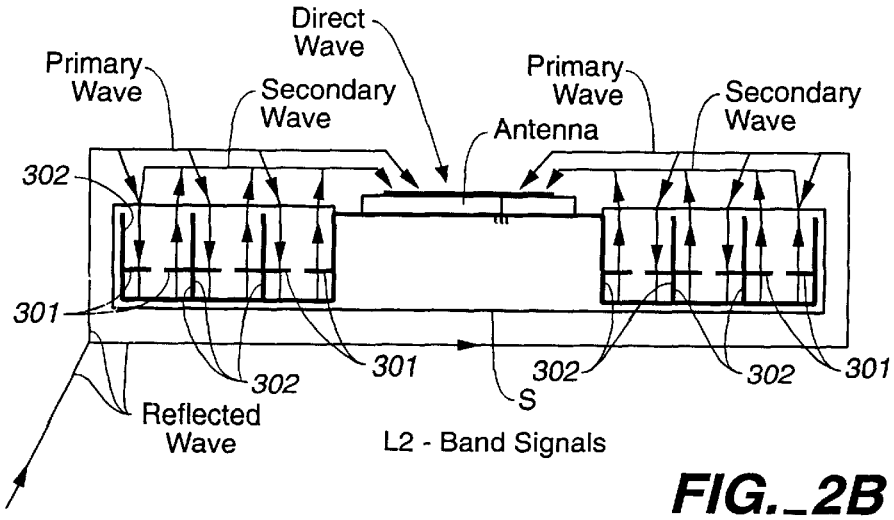
FIG. 2B is a schematic view of the wave propagation of an L2 signal in a ground plane structure according to the first invention.
Figure 3A:
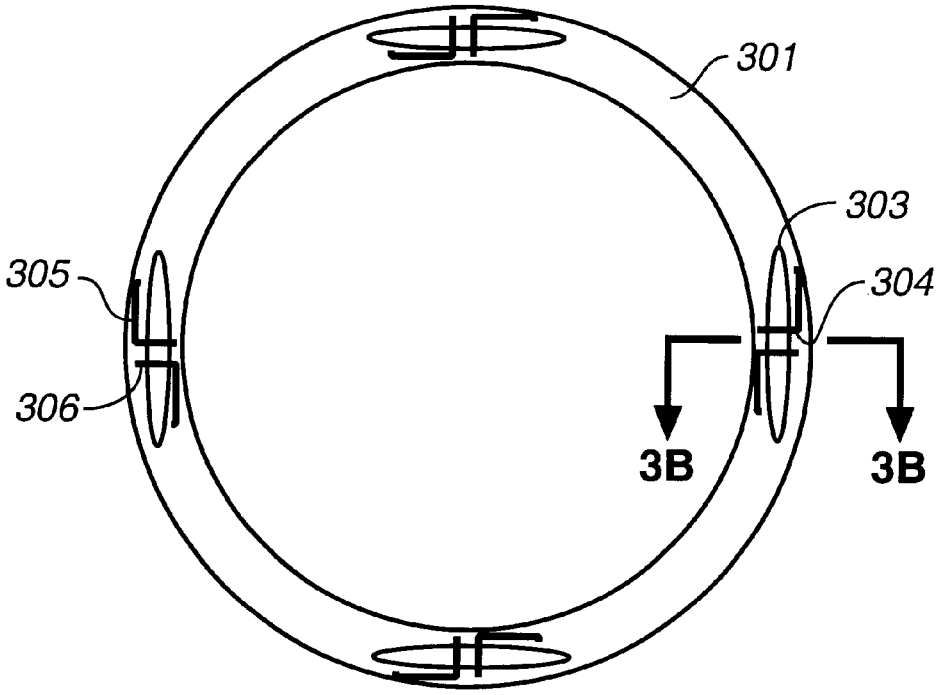
FIGS. 3A and 3B show a top plan view and a cross-sectional view, respectively, of a first embodiment of the filter construction according to the first invention.
Figure 3B:
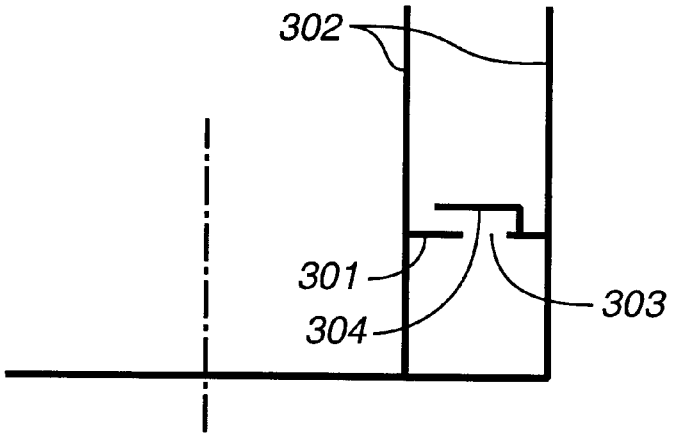

FIG. 2B shows a cross-sectional view of the choke-ring ground plane according to the first invention of the present disclosure. This ground plane enables good multipath rejection to be achieved for two frequency bands simultaneously. The ground plane may comprise the basic choke-ring structure of the prior art devices, where the grooves are divided by a set of groove walls 302, and where the groove depth is slightly larger than $\lambda_{L2}/4$ ($\lambda_{L2}/4$ is one-fourth of the center wavelength of the L2 band). The above second invention of the present disclosure may be combined with this, and a groove depth of approximately $0.88\cdot\lambda_{L2}/4$ to approximately $0.98\cdot\lambda_{L2}/4$ may instead be used. In contrast to the prior art, the ground plane according to the first invention (FIGS. 2A–2B) includes an intermediate ground plane 301 in at least one of the grooves, and preferably in each of the grooves, as shown in FIGS. 2A and 2B. FIGS. 3A and 3B show a top view and a cross-sectional view, respectively of one intermediate ground plane 301 for one groove. The intermediate ground plane is placed in the groove at a depth of approximately $\lambda_{L1}/4$ (one-fourth the center wavelength of the L1 band). In preferred embodiments, the depth of the intermediate ground plane is ideally in the range between approximately $0.92 \cdot \lambda_{L1}/4$ and approximately $0.97 \cdot \lambda_{L1}/4$, in accordance with the second invention of this disclosure. However, depths of $\lambda_{L1}/4$ and slightly more may be used, such as that found in a range of $0.95 \cdot \lambda_{L1}/4$ to $1.05 \cdot \lambda_{L1}/4$. In some embodiments where a small number of electromagnetic filters (e.g., 1 or 2) are used per aperture 303, the depth of the intermediate ground plane is in the range between approximately $0.78 \cdot \lambda_{L1}/4$ and approximately $0.97 \cdot \lambda_{L1}/4$. These filters are described in greater detail below.

The intermediate ground plane 301 divides each groove into two sections: a top section and a bottom section. For each intermediate ground plane 301 in each groove, a plurality of apertures 303, or slots 303, are formed through the surfaces of intermediate ground plane 301, which connects the top and bottom sections of the groove to one another. Slots 303 will enable the multipath signals in the L2 band to pass from the top section of the groove to the bottom section of the groove, and then reflect back from the bottom section to the top section. This enables the multipath signals in the L2 band to undergo a travel distance of approximately twice $\lambda_{L2}/4$, which is approximately $\lambda_{L2}/2$. On the other hand, the intermediate ground plane 301 will enable the multipath signals in the L1 band to stay within the top section of the groove, and thereby undergo a travel distance of approximately twice $\lambda_{L1}/4$ which is approximately $\lambda_{L1}/2$. Therefore the groove depth seen by each frequency band will be different. For L1 it will be equal to the distance from the groove's open ends to the intermediate ground plane, and for L2 it will be the total groove depth. As a result, comparable multipath rejection can be obtained for both L1 and L2 signals, and the rejection performance of one band does not have to be compromised for the performance of the other band.

It is preferred that the signals in the L1 band be substantially prevented from entering the bottom section of the groove, and that the signals in the L2 band be substantially allowed to enter the bottom section without being reflected by the intermediate ground plane by a substantial degree. Specifically, it is preferred that the transmission of the L1 signals through the apertures to the bottom section of the groove be blocked to a greater degree than the transmission of the L2 signals, and that the L1 signals be reflected at the intermediate ground plane 301 to a greater degree than the L2 signals. This may be readily achieved by incorporating a novel electromagnetic filter in the vicinity of at least one aperture (or slot) 303, and preferably a novel filter in the vicinity of each aperture (or slot) 303 in each intermediate ground plane 301. Each filter blocks the transmission of waves in the L1 band, and enables transmission of waves in the L2 band between the top and bottom sections of the groove. It may be said that the filter blocks the transmission of L1 frequencies through apertures 303 to a greater extent (i.e., amount) than the transmission of L2 frequencies. Equivalently, it may be said that the filter enables the transmission of L2 frequencies through apertures 303 to a greater extent (i.e., amount) than the transmission of L1 frequencies. In preferred embodiments, the filter effectively acts to pass the waves of the L2 signal (FIG. 2B) and reflects waves of L1 signal (FIG. 2A).

The filters according to the first invention may be implemented in several forms. A number of these forms are described herein. FIGS. 3A and 3B show a first general embodiment of the filter construction according to the first invention. One filter 304 comprises a first conductive stub 305 and a second conductive stub 306, each of the stubs preferably being disposed so as to cross over the aperture 303. One end of each stub 305, 306 is shorted to intermediate ground plane 301 near the edge of aperture 303, and the other end can be shorted or opened. Stub 305 functions to block the transmission of the L1 frequency signals through the adjacent slot 303 to the bottom section of the groove. This may be accomplished by an appropriate selection of the stub's length. If the L1 and L2 frequencies are somewhat close in value, which they are for GPS systems, stub 305 may also act to block a portion of the L2 frequencies. In this case, stub 306 functions to compensate for the blocking effect that stub 305 has on signals in the L2-band, and thereby increases the transmission of L2 signals through the adjacent aperture 303. Additionally, aperture 303 may sometimes have an imaginary admittance component which hinders the transmission of L2 signals through the aperture 303 (this may occur if the slot length is very different from a length of $\lambda_{L2}/2$). Stub 306 may also be used to compensate for this imaginary admittance component. The length of stub 306 may be chosen to accomplish these functions, as described below in greater detail.

In most cases, the apertures 303 can be constructed to have very little imaginary impedance by making their lengths around $\lambda_{L2}/2$ (usually within 5%—$0.95 \cdot \lambda_{L2}/2$ to $1.05 \cdot \lambda_{L2}/2$) thereby creating a resonant slot. Under this condition, the dual frequency operation of network 304 can be obtained as follows. One stub (for example, 305) near the aperture (slot) 303 is constructed to have substantially zero input impedance at the L1 frequency. The input impedance is measured from the circuit perspective of the grounded end of the stub looking toward the second end, which may be grounded or open. The zero impedance of the stub may be achieved by grounding the second end of the stub to the intermediate ground plane at a point that is on the opposite side of aperture (slot) 303. In this case, the length of the stub is approximately $\lambda'_{L1}/2$, where $\lambda'_{L1}$ is the wavelength of the L1-band signal when the L1-band signal propagates along the length of the stub. As another approach, the opposite end of the stub is left open, and the length of this stub is set at approximately $\lambda'_{L1}/4$. In preferred embodiments, the length of the stub is typically within 10% of the specified value (e.g, $0.9 \cdot \lambda'_{L1}/2$ to $1.1 \cdot \lambda'_{L1}/2$ for grounded second end, $0.9 \cdot \lambda'_{L1}/4$ to $1.1 \cdot \lambda'_{L1}/4$ for an open second end.)

The wavelength $\lambda'_{L1}$ will be called the "in-line" wavelength. For a stub suspended in air, the in-line wavelength $\lambda'_{L1}$ of the L1-band signal in the stud is equal to the free-space wavelength $\lambda_{L1}$ of the signal. This equality is known to those skill in the transmission line art. For a stub that is partially or wholly surrounded by one or more dielectric materials which have relative magnetic permeabilities of 1, it is also known in the art that the in-line wavelength $\lambda'_{L1}$ is equal to the free-space wavelength $\lambda_{L1}$ divided by the square-root of the effective dielectric constant $\epsilon_{eff}$ of the material surrounding the stub: $\lambda'_{L1}=\lambda'_{L1}/\sqrt{\epsilon_{eff}}$. Formulas for computing $\epsilon_{eff}$ for typical structures are also well known in the art.

Both of the above stub constructions effectively short-circuit the slot for the L1 signal. This may be explained as follows. If aperture 303 were not present, the L1 signals would cause currents to flow in the intermediate ground plane. These current flows enable the intermediate ground plane to reflect back the L1 wave when it hits the ground plane. The introduction of apertures 303 interrupts the flow of these currents, thus preventing the desired L1-wave reflection. However, the short circuit stub 305 re-establishes the connection for these currents across the aperture 303. The impedance of stub 305 is dependent upon frequency, and so its impedance is different for the L2 frequency. The length of the other stub (for example, 306) is chosen to counteract the impedance that the first stub (305) has at the L2 frequency, and to thereby make the entire system transparent for L2, or at least more transparent. One end of the second stub is grounded at one side of the slot, and the second end may be left open or grounded at the other side of the slot. The grounded ends of stubs 305 and 306 can be connected to different sides of aperture (slot) 303 (as shown in FIG. 3), or to the same side (as is done in another embodiment shown in FIG. 4A). In any case, their lengths are chosen as indicated above. For better operation, several pairs of stubs can be arranged over each aperture (slot) 303 (as is done in another embodiment shown in FIG. 5).

Figure 4A:
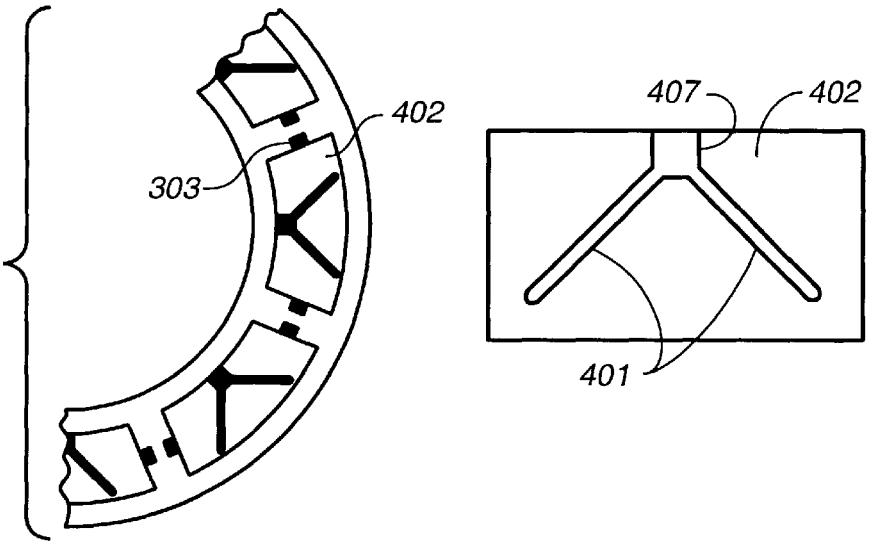
FIG. 4A shows a second embodiment of the filter construction according to the first invention.
Figure 4B:
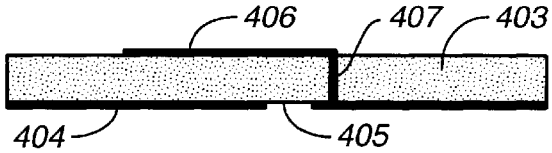
FIGS. 4B and 4C show a third embodiment of the filter construction according to the first invention.
Figure 4C:
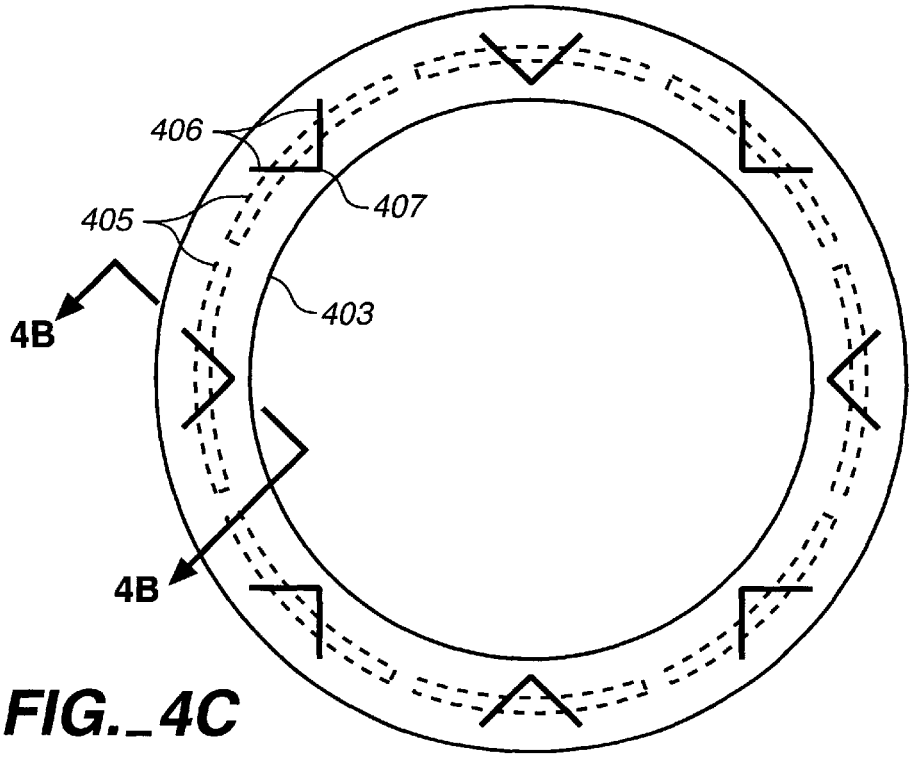

Stubs 305 and 306 may each comprise segments of wire, or may comprise microstrip lines formed on a dielectric board. FIG. 4A shows an embodiment where stubs 305 and 306 comprise microstrip lines 401 formed on single layer PC board 402. In this case, boards 402 are mounted in the vicinity of apertures (slots) 303. Vias 407 (also called through holes) are formed through the board 402 to provide an electrical connection between the intermediate ground plane and those stub ends which are to be grounded. The electromagnetic filters can also be made with microstrip technology. In this case, referring to FIGS. 4B and 4C, the stubs may be formed on a dual layer PC board 403, with the conductive bottom layer 404 being used to implement the intermediate ground plane and the conductive top layer 406 being used to construct the stubs. Slots 405 are formed in the conductive bottom layer 404 to provide apertures (slots) 303. The PC board 403 may have the shape of a ring, with a width substantially equal to the groove width. FIG. 4C shows a top plan view of board 403 with the patterned conductive top layer 406 exposed (the bottom layer 404 is hidden from view, and FIG. 4B shows a cross-sectional view. Slots 405 are shown by dashed lines in the top plan view of FIG. 4C. The PC board may then be inserted into the groove to provide the intermediate ground plane, slots, and the filter stubs in a single integrated unit. A ledge (or rim), or a series of small tab ledges, may be formed along the groove walls 302 to position and anchor the board within the groove.

In each of the above implementations, the characteristic impedance of each stub may be computed or measured by methods well known to the art. For wires suspended in air, the characteristic impedance $Z_0$ is the square root of the inductance $L_0$ per unit length divided by the square root of the capacitance $C_0$ per unit length: $Z_0=(L_0/C_0)^{1/2}$. Methods of computing $L_0$ and $C_0$ from the dimensions of stubs 305, 306, their distances from the intermediate ground plane, and the dielectric constant of the surrounding dielectric material are well known to the art. Computer programs for computing $L_0$, $C_0$, and $Z_0$ are commercially available. Several measurement methods are also well known. Accordingly, determining the values of $L_0$, $C_0$, and $Z_0$ for a given stub construction is well within the ordinary skill of the art. The characteristic admittance $Y_0$ may be determined from $Z_0$ as follows: $Y_0=1/Z_0$. For stubs which comprise conductive traces formed on PC board and for microstrip structures, the characteristic impedance is given by well known approximation formulas and graphs.

Propagation of L2 Band Signals through Apertures 303.

The propagation of L2-band signals through apertures 303 may be understood and described by electromagnetic diffraction theory. In the vicinity of surface S (FIG. 1) the primary wave field has a rather complex structure. In any case, this field can be expanded into a series of angular spectrum harmonics. For the magnetic field $H_\phi$ component and the electric field component, it is possible to write:

$$E_r(r,\varphi)=\sum_{p=-\infty}^{\infty} C_{E,p}(r)\cdot\exp(-ip\varphi)$$

$$H_\varphi(r,\varphi)=\sum_{p=-\infty}^{\infty} C_{H,p}(r)\cdot\exp(-ip\varphi)$$

Here r is the distance from the ground plane axis to the observation point and $\phi$ is the azimuth angle.

It is well known, that the GPS antenna must be able to receive a right-hand circular polarized field in order to obtain high precision measurements. Such antennas have a reception pattern with good axial ratio and high azimuth-rotational symmetry. This is obtained by the proper antenna design, as is well known in the art. One of the possible ways of such a design is to use a plurality of antennas with N (N>2) excitation points arranged symmetrically according to the antenna axis with angular distance $\Delta\phi=2\pi/N$. The power combining unit of such an antenna combines signals from these inputs with the same amplitudes and progressive phase shift from point to point $\Delta\alpha=2\pi/N$. Another way is to use helix antennas. For all of these antenna constructions, the term of equation (1) with p=−1 is the dominant one. All the other terms are parasitic. For high precision antenna their impact on antenna output signal is small. This observation will simplify our following analysis as we will only use the dominant term in equations (1) with p=−1.

Choke-ring grooves can be treated as shorted pieces of coaxial waveguides. Referring to FIG. 6A, each groove has a width $\Delta^k$, a middle (or average) radius $r^k_{middle}$, and a perimeter $P^k$, as defined below:

$$\Delta^k=(r^k_{max}-r^k_{min})<P^k=2\pi r^k_{middle}$$

$$r^k_{middle}=(r^k_{max}+r^k_{min})/2$$

$$P^k=2\pi r^k_{middle} \tag{2A}$$

where "k" is an index which identifies the groove (e.g., k=1, 2, . . .). Typical embodiments of the inventions of the present application have the following relationships between these quantities and the wavelength $\lambda$ of the signal being processed by the choke ring:

$$\Delta^k<<P^k,\ \text{or}\ \Delta^k=(r^k_{max}-r^k_{min})<<P^k=2\pi r^k_{middle}$$

$$\Delta^k<<\lambda$$

$$P^k\geqq\lambda. \tag{2B}$$

Under the conditions of the above relationships, a number of modes in these waveguides can propagate. While the above may be applied to signals in both the L1 and L2 bands, we will focus here on signals in the L2 band since we are describing the propagation of L2 signals through the slot apertures 303.

For groove dimensions specified in (2), $r^k_{max}/r^k_{min}\cong1$. So, for eigenvalues calculation, each groove can be approximately treated as rectangular waveguide, turned into the shape of a circle. Referring to FIG. 6B, the cross-section dimensions of this rectangular waveguide will be:

$$a=2\pi r^k_{middle},\ \text{and}\ b=\Delta^k \tag{3}$$

The critical wavelengths for the propagation of TE-modes and TH-modes in such waveguides are as follows:

$$\lambda_{mn}^{TE} \approx \frac{2}{\sqrt{(2m/a)^2 + ((n-1)/b)^2}} \quad (4)$$

$$\lambda_{mn}^{TH} \approx \frac{2}{\sqrt{(2m/a)^2 + (n/b)^2}} \quad (5)$$

where "m" is an integer index for the width of the waveguide (the "a" dimension) and where "n" is an integer index for the height of the waveguide (the "b" dimension). Indices "m" and "n" denote numbers of the mode, and are representative of the configuration of the electric and magnetic fields in the waveguide. TH-modes are also known as TM-modes. From (4) and (5) follows, that $TH_{mm}$ are always cut-off and $TE_{mm}$ modes are cut-off for any m and n>1. Only the $TE_{m1}$ modes can propagate. Also, the TEM mode of coaxial wave guide can propagate in any case.

When the groove width Δ is set to be the same for all grooves, the number of modes that can propagate increases as the average radius $r^k_{middle}$ increases. So, for the the innermost groove (the first one counting from the ground plane center), the number of possible propagating modes is smaller than that for the outermost groove (the last one from the center).

From boundary conditions, it follows that the primary wave excites in the grooves electromagnetic fields with the same angular spectrum as provided in equation (1) above. Each term of this spectrum can be treated as sum of coaxial waveguides modes, with the spectrum of each mode being given as follows (with n=):

$$E_{mn}(z,r,\phi)=E_{mn}(z,r)\cdot(\cos(m\phi))+i\cdot\sin(m\phi)) \quad (6).$$

As it follows from the above of equations (1), the term with m=−1 is the dominant one. It means that two orthogonally polarized $TE_{11}$ modes with 90 degrees phase shift between them are dominant. All the other modes are parasitic.

It is well known that propagating higher order terms of equation (6) require a wavelength that is larger then the wavelength of the dominant one. This means that the groove depth is not optimal for these modes. Cut-off modes of the secondary waves are excited by the groove edges. For them, the groove depth is also not optimal. This fact is not very important for ground planes without filters because, as it was mentioned above, the non-dominant modes have comparatively small impact on the antenna output signal.

But for ground plane with filters, the partial transformation of the dominant mode power into the parasitic modes by the filter slots is possible. This will lead to an increase in the amplitudes of the higher-order modes, and a commensurate decrease in the multipath rejection. However, this effect can be canceled by selecting the number of slots in each groove to be above a given amount based on the dimensions of the groove. This selection is now described.

Figure 7:
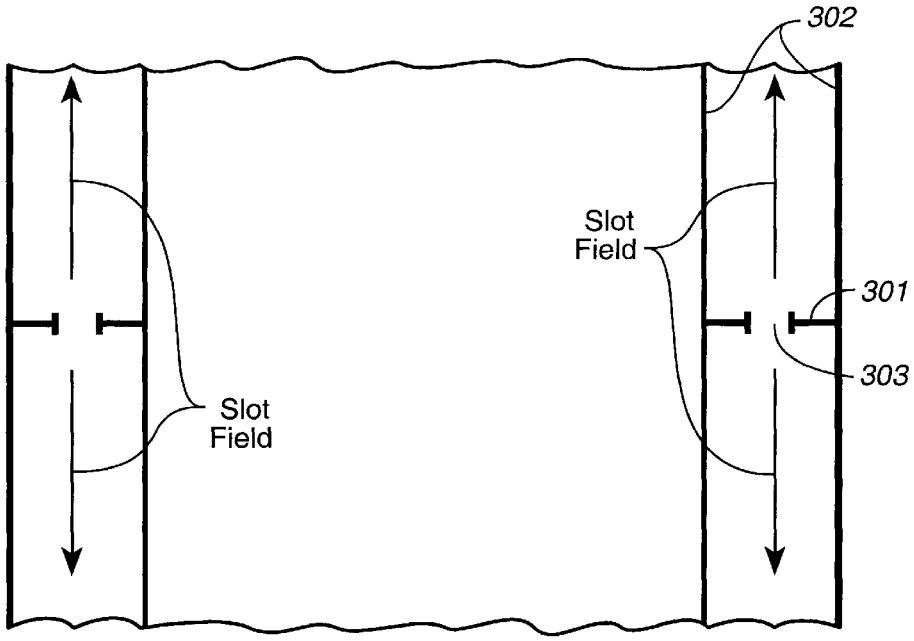
FIG. 7 is a cross-sectional view of the wave structure in one groove with a slot aperture, according to analysis of the first invention.

FIG. 7 is a cross-sectional view of a groove with slot filter. Both sides of the groove are shown.

Let a sum of two TE11 modes be incident and propagating from one groove open end towards the slot filter. These two modes are orthogonally polarized with 90 degrees phase shift between them:

$$E_1(r,\phi)=E_1(r)\cdot(\cos(\phi)+i\cdot\sin(\phi)) \quad (7),$$

In the L2-band, the electromagnetic field specified by equation (7) generates electrical currents on intermediate ground plane 301 (the conductive ring). These currents excite apertures 303, and apertures 303 generate fields on both sides of ring 301.

Let the slots 303 be arranged periodically on the intermediate ground plane 301 with angular distance Δϕ (as measured from the center point of the ground plane), and let $N_{Sl}$ represent the total number of slots. Then, the field generated by the slot excitations can be written as follows:

$$E(z,r,\varphi)=\sum_{m=-\infty}^{\infty} E_m(z,r)\cdot\exp(-i\cdot(N_{Sl}\cdot m+1)\cdot\varphi), \quad (8)$$

So, the field radiated by the slots can be treated as a sum of coaxial waveguide modes with angular period $N_{Sl}\cdot m$.

As indicated above, we are letting the $TE_{11}$ modes be the dominant modes, and we are letting the other modes be cut-off. This can be obtained by the selection of the number of slot apertures $N_{Sl}$. As was mentioned above, all $TH_{mn}$ and $TE_{mn}$ with n>1 modes are in cut-off regime For $TE_{m1}$ modes with m>1 to be cut-off, it is necessary to have $$\lambda>\lambda_{m1}^{TE.} \quad (9)$$

where $\lambda>\lambda_{m1}^{TE}$ is given by equation (4) with the index "m" of equation (4) set as follows:

$$m=N_{Sl}p+1, \text{ with } p=\pm1,\pm2,\ldots,\text{and } n=1. \quad (10)$$

So, for cut-off it is necessary to have $$\lambda>2a/(N_{Sl}-1) \quad (11)$$

or $$\lambda>2\pi(r_{min}^k+r_{max}^k)/(N_{Sl}-1) \quad (12)$$

So, the minimum slot number for the k-th groove is $$N_{sl}>2\pi(r_{min}^k+r_{max}^k)/\lambda+1 \quad (13)$$

Intermediate ground planes 301 which have this minimum number of slots will cancel the effects of power from the dominant mode being transferred into the parasitic modes.

As is it well known, the cut-off modes contribute to the imaginary part of the slot admittance of each slot aperture 303. Because of the above-mentioned angular periodicity of the field exited by the slots, it is possible to use the periodic array theory based on Floquett's theorem as a basis for a rigorous field analysis of the slotted structure. As it follows from that theory, the entire space domain can be subdivided into subdomains, so-called "partial waveguides" or "Floquett waveguides." So, let us treat a periodic array cell with only one slot as a partial (Floquett) waveguide.

Figure 8:
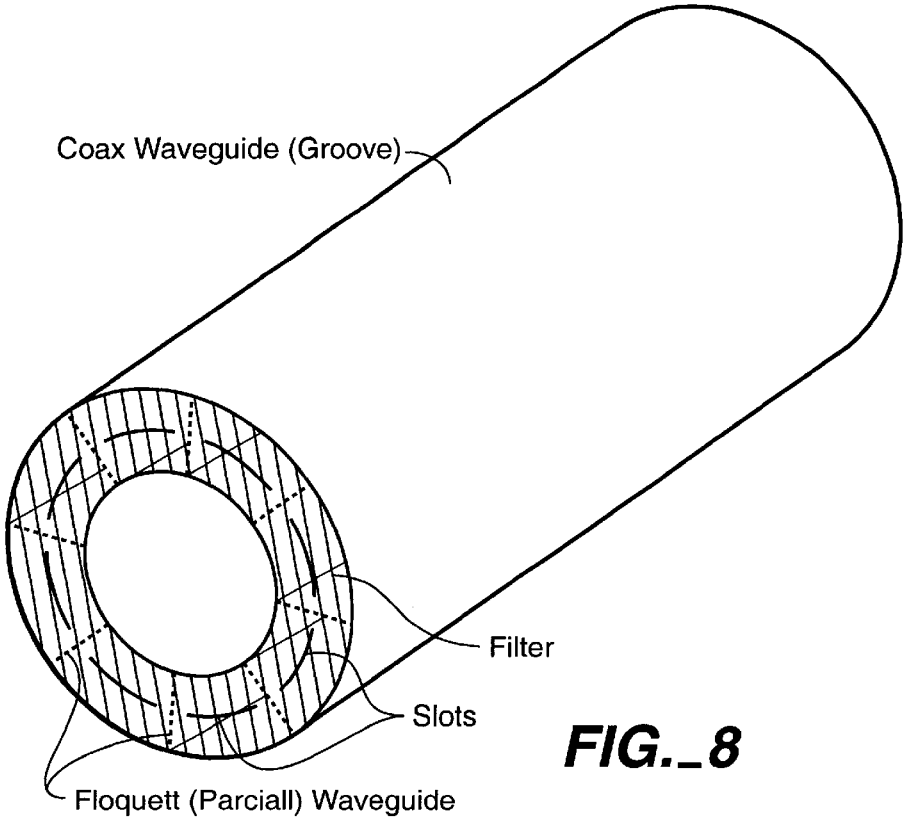
FIG. 8 shows a system of partial (Floquett) waveguides in one groove, according to the analysis approach of the first invention.
Figure 9A:
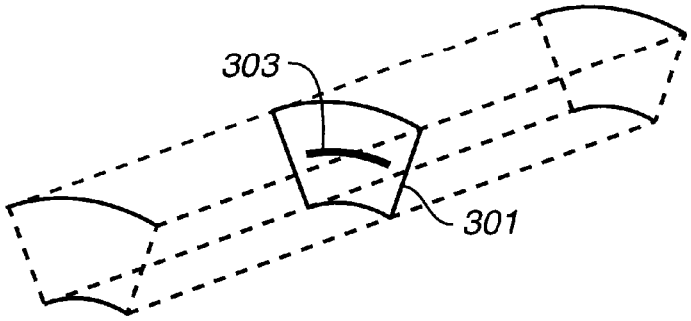
FIGS. 9A–9C show the field analysis within one partial (Floquett) waveguide, according to the analysis approach of the first invention.

FIG. 8 shows a system comprising several partial (Floquett) waveguides in one groove. FIG. 9A shows one partial (Floquett) waveguide, which has one slot. Let us take one Floquett waveguide as infinite with one metal ground plane (diaphragm) 301. The incident wave excites the slot through currents in the ground plane, and the slot in turn radiates fields on both sides of the ground plane. The field on each side is a sum of waveguide modes. One of these modes is dominant, all the others are cut-off. For brevity said field will be called the "slot field." Let us analyze the slot field on both sides of the ground plane in two corresponding space domains which we will call domains 1 and 2, and which are shown in FIGS. 9B and 9C.

Figure 9B:
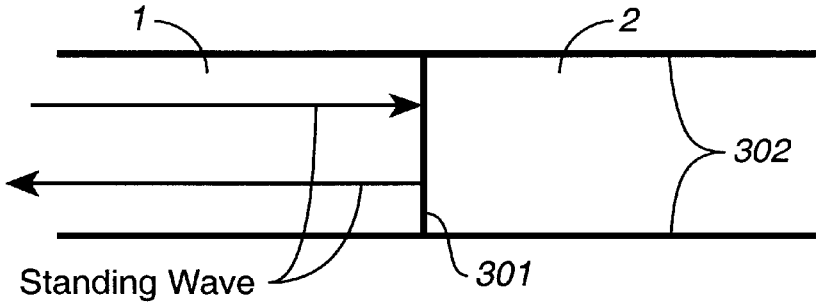
Figure 9C:
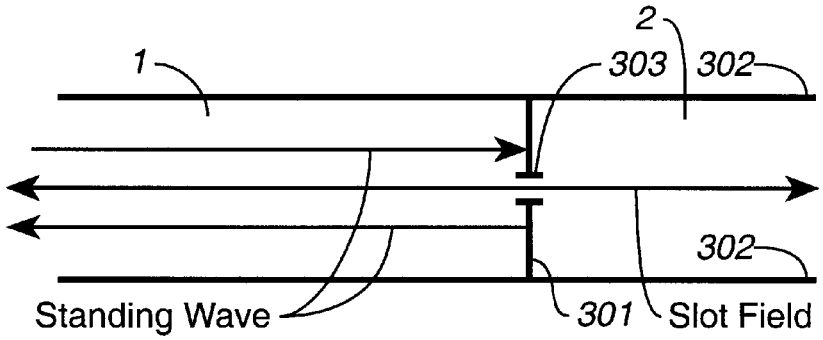

If there are no slots, the Floquett waveguide is shorted (FIG. 9B). Then, in space domain 2, no field occurs. In domain 1, a standing wave is generated between the groove open end and the ground plane. When the slot is not shorted, the slot field has to be added (FIG. 9C). Higher order modes of the Floquett waveguide contribute to the reactive (imaginary) slot admittance. Let us show that by proper slot tuning the Floquett waveguide will be transparent for the dominant mode, so it will pass from domain 1 into domain 2 without reflection.

The voltage $U_{Sl}$ between slot edges at the inputs of stubs 305 and 306 is $$U_{Sl}=M/Y \tag{14}$$

where M is the magnetomotive force, which depends on magnetic field magnitude of standing wave in space domain 1, and where Y is the dual-side slot admittance.

Expressions for Y and M are provided in an attached Appendix.

The amplitudes of the waveguide modes, as excited by the slot, are proportional to $U_{Sl}$. Let us denote the coefficient in this proportionality as "n", and call this the transformation factor. This factor is a real-number quantity (its imaginary part is equal to zero).

The dominant mode propagation can be expressed in terms of an equivalent line with a characteristic impedance W. The voltage U in this line is proportional to the E-field (electrical field), and the current in this line is proportional to the H-field (magnetic field). The coefficients of these proportions are chosen for transmitting power to be the same for partial ("Floquett") waveguide and equivalent line.

Let us reference the longitudinal coordinate z of this line from the slot. In this case, for voltage distribution along the equivalent line it is possible to write for domain 1:

$$U_1(z)=U_1^0\cdot\exp(-ik_Z\cdot Z)-(U_1^0-n\cdot U_{Sl})\cdot\exp(ik_Z\cdot Z) \tag{15}$$

and for domain 2

$$U_2(z)=n\cdot U_{Sl}\cdot\exp(-ik_Z\cdot Z) \tag{16}$$

Here $U_1^0$ is the amplitude of the incidental wave, and $k_Z$ is the propagation constant along the equivalent line. The slot is located at Z=0.

At the slot plane, it follows from the Poynting theorem that the sum of powers of reflected wave in domain 1 and the wave transmitted to domain 2 has to be equal to the power of the incident wave. Because each of these powers is proportional to the square of the corresponding voltage (with the same characteristic impedance as a coefficient), it is possible to write:

$$|U_1^0-nU_{Sl}|^2+|nU_{Sl}|^2=|U_1^0|^2 \tag{17}$$

or $$2|nU_{Sl}|^2-U_1^0(nU_{Sl})^*-(U_1^0)^*nU_{sl}=0. \tag{18}$$

Here $(nU_{Sl})^*$ and $(U_1^0)^*$ are the complex conjugated quantities of $nU_{Sl}$ and $U_1^0$, respectively. In any case, it is possible to take the phase of the incident wave as zero, so as to have:

$$U_1^0=(U_1^0)^*. \tag{19}$$

In this case, the magnetomotive force is a real quantity, so $$M=M^* \tag{20}$$

If a slot with the system of the above-described stubs is tuned to have no imaginary part in its admittance, then $$Y=Y^*, \tag{21}$$

From (18)–(21), it follows, that $$nU_{Sl}=U_1^0 \tag{22}$$

As a result, the total amplitude of the reflected wave in domain 1 is zero, and the amplitude of the wave transmitted to domain 2 is equal to the amplitude of the incidental wave. So, the incident wave passes through the aperture filter structure without reflection.

The frequency behavior of the slot admittance is the same as that of a parallel resonant circuit. So, it is small at the resonant frequency and comparatively large far from the resonant frequency. Because M is not changed too much, so it follows from equation (14) that the amplitude of the field waves exited by the slot, which are proportional to $U_{Sl}$, decrease in value when Y increases in value (and vice-versa). An increase in Y leads to the increase of the reflected-wave amplitude. So, the transparent ability of the filter decreases.

The increase of the slot admittance can be obtained by making the slot shorter. If the slot length tends to zero, the slot admittance tends to infinity, and the amplitudes of waves excited by slots tend to zero. That is why the slot filter transparency can be made infinitely small. Incident wave will be reflected by the filter as by a metal plane.

If the slots are tuned to be transparent for L2 signal, the incident wave passes through the aperture and filter without reflection. This wave is reflected by the grooves bottom and passes through the aperture and filter towards the grooves open ends.

Because the distance between the aperture/filter and the groove bottom is small compared with the L2 wavelength, cut-off higher order modes, excited by the slots, reach the grooves bottom also. Because, as mentioned above, these modes contribute to the slot admittance imaginary part, their impact can be compensated by tuning of the stub lengths and/or of the slot dimensions.

Shorting of L1-Band Signals.

Let us turn to the slot filter operation in L1 band.

As said above, the amplitude of the reflected wave can be made equal to the amplitude of the incident wave by making the slot length smaller. This can be done by shorting the slots in one or several points by means of stubs.

For example, let the stub 305 be a piece of wire, or of microstrip line, that crosses the slot and has one of its ends connected to intermediate ground plane 301 at one of the slots edges. When the other end of stub 305 is opened, the stub will short the slot at the L1 frequency if the stub length is equal to a quarter of the in-line wavelength $\lambda'_{L1}$ of the L1-band signal. The stub will also short the slot when the stub's length is equal to $\lambda'_{L1}\cdot(2n+1)/4$, where n is any integer from 0 to infinity. When the other end of stub 305 is connected to the ground plane 301, the stub will short the slot at the L1 frequency if its length is equal to a half of the in-line wavelength $\lambda'_{L1}$ of the L1-band signal. It will also short when its length is equal to $\lambda'_{L1}\cdot n/2$, where n is any integer number from 1 to infinity. In preferred embodiments, the length of the stub is typically within $\pm0.1\cdot\lambda'_{L1}/2$ of the specified value for a stub with a grounded second end, and withing $\pm0.1\cdot\lambda'_{L1}/4$ for a stub with an open second end.

In both cases, the stub impedances are imaginary at the L2 frequency. In order to compensate this effect, another stub 306 is used. This second stub 306 is arranged next to the first stub 305, has its first end grounded, and crosses the aperture slot 303. Its second end can be also opened or shorted. If slot aperture 303 has a zero imaginary component to its admittance, then the impedance of stub 306 is preferably made to be of the same magnitude as that of the first one, but opposite in sign. In this case, a pair of stubs does not impact on the slot tuning for L2. It is possible to attach several pairs of stubs to one slot. If slot aperture 303 has a non-zero imaginary component of significant magnitude, then the length and/or characteristic impedance of stub 306 may be adjusted to compensate for the slot's imaginary impedance, as well as for the impedance of stub 305.

In this manner, the combination of stubs 305–306 shorts the slot. When a slot is shorted for the L1 frequency band at its center by a single set of stubs, it can be represented as a two slots that have half the length of the original slot. Each of the shorter slots has an increased admittance for the L1 frequency band in comparison to the admittance of the original slot. In practice, a slot which is shorted at its center by a pair of stubs 305,306 is not equivalent to a metal plane because of the finite value of the shorted slot admittance. So, if the filter structure formed by this slot and the pair of stubs is placed in a groove at the depth of approximately $\lambda_{L1}/4$ from the top of the groove, the phase of the reflected L1-band wave would not be the same as that found in the optimal L1 choke ring. This non-optimal performance may be improved by at least the following two ways, or a combination thereof. First, the intermediate ground plane 301 and filter structure can be raised from the $\lambda_{L1}/4$ position by approximately 6 mm to approximately 10 mm in order to correct the phase of the reflected wave to its optimal value. The distance of 6 mm to 10 mm corresponds to a distance of $\lambda_{L1}/32$ to $\lambda_{L1}/19$, and the distance of the ground plane from the top of the groove would range between approximately $(\lambda_{L1}/4-\lambda_{L1}/32)$ and approximately $(\lambda_{L1}/4-\lambda_{L1}/19)$, which is $7/32\cdot\lambda_{L1}$ to $15/76\cdot\lambda_{L1}$. The distance by which the ground plane 301 and the filter structure are raised may be determined empirically from measurement (e.g., testing at various distances to find the best performance), or from standard wave analysis given the value of the finite slot admittance of the shorter slots. As a second way, several pairs of stubs 305,306 may be used along the slot, thereby creating a larger number of slots that have shorter lengths, and thus have higher slot admittance at the L1 frequency.

For the L2-band signal, the filter formed by stubs 305, 306 and aperture 303 is transparent. The groove depth is equal to it natural one, which is optimal for L2.

By appropriate selection of the stubs configuration, it is possible to obtain the necessary bandwidth for both L1 and L2 bands. For example, it is possible to make a dual frequency filter, working for both GPS and GLONASS signals.

For some applications it may happen that the length of slots will be so big that it will be impossible to arrange them along one circle in a groove. On FIG. 10A, such situation is depicted. However, in this case the slots of one groove can be subdivided into two subsystems of slots, each arranged along a respective circle. The field angular period in equation (8) will be $2\Delta\phi$ for each sub-system, and the slots of the subsystems are interleaved with respect to one another. All of the above analysis for the case of slots disposed around one circle applies equally to the case of two or more subsystems of slots. As an alternative to the configuration shown in FIG. 10A, the inventors have found that the slot configuration shown in FIG. 10B may be used and that this configuration provides better resonance properties. In this configuration, there are two subsystems of slots, each at respective radii, but the slots preferably do not have radial overlap. Each end portion of each slot is turned inward or outward by approximately 90 degrees to form a respective wing portion of the slot. The wing portions of the slots on the inner radius are turned inward toward the center point of the ground plane, and the wing portions of the slots on the outer radius are turned outward from the center point. The wing portions increase the electrical size of the slot over that provided by the central portion of the slot, and also aid in making the slot resonate. The wings may extend to up to the groove walls 302, in which case the walls 302 function as electrical shorts for the ends of the slots.

Stub Tunning.

As indicated above, stub 305 is configured by its connections and its length to provide a zero impedance (a short) at the L1-band frequency. In order to select the configuration of stub 306, which is intended to compensate for the impedance effects of stub 305 at the L2 frequency, we first determine the admittance that stub 305 has at the L2 frequency (admittance is the reciprocal of impedance). If the second end of stub 305 is open and if the length $l_{305}$ of stub 305 is equal to $n\cdot\lambda'_{L1}/4$ where n is a positive and odd integer, then standard transmission line and microstrip line analysis gives an admittance at the L2 frequency of:

$$Y_{305}=iY_{0,305}\tan(\alpha_{L2,305}\cdot n\cdot\lambda'_{L1}/4)\ \text{(open second end)}$$

where i is the square root of −1 (i is the complex number indicator), where $Y_{0,305}$ is the characteristic admittance for stub 305, and where βL2,305 is the propagation constant for signals traveling in stub 305. The in-line wavelength of an L2-band signal traveling (e.g., propagating) in stub 305 is denoted herein as $\lambda'_{L2}$. As is well-known in the art, the propagation constant $\alpha_{L2,305}$ is defined in terms of the in-line wavelength $\lambda'_{L2}$ as follows: $\beta_{L2,305}=2\alpha/\lambda'_{L2}$. The in-line wavelength $\lambda'_{L2}$ can be related to the free space wavelength $\lambda_{L2}$ as follows: $\lambda'_{L2}=\lambda_{L2}/\sqrt{\epsilon_{eff}}$, where $\epsilon_{eff}$ effective dielectric constant of the material surrounding the stub. The latter relationship assumes a relative magnetic permeability $\mu_r$ of 1 for the material surrounding the stub. Several well known approximation tables and formula are available to persons of ordinary skill in the art to find the value of $\epsilon_{eff}$ for a particular stub structure. When the stub is a wire suspended in air, $\epsilon_{eff}=1$ and $\lambda'_{L2}=\lambda_{L2}$, and $\beta_{L2,305}=2\pi/\lambda'_{L2}=2\pi/\lambda_{L2}$. For a wire suspended in air, the art also computes $\beta_{L2,305}$ as: $\beta_{L2,305}=2\pi f_{L2}\sqrt{L_0C_0}$, as an equivalent. With this background, it may be seen that the above form for $Y_{305}$ reduces to $$\begin{aligned}Y_{305} &= iY_{0,305}\tan([2\pi/\lambda'_{L2}]\cdot n\cdot\lambda'_{L1}/4)\\ &= iY_{0,305}\tan(\pi/2\cdot n\cdot\lambda'_{L1}/\lambda'_{L2})\\ &= iY_{0,305}\tan(\pi/2\cdot n\cdot\lambda_{L1}/\lambda_{L2})\quad\text{(open second end)}\end{aligned}$$

If the second end of stub 305 is grounded and if its length $l_{305}$ is equal to $n\cdot\pi'_{L1}/2$ where n is a positive and even integer, then standard transmission line and microstrip line analysis gives an admittance at the L2 frequency of:

$$Y_{305}=-iY_{0,305}\ \text{cotan}\ (\beta_{L2,305}\cdot n\cdot\lambda'_{L1}/2).\ \text{(grounded second end)}$$

This can be simplified to:

$$Y_{305}=-iY_{0,305}\ \text{cotan}\ (\pi\cdot n\cdot\lambda_{L1}/\lambda_{L2})\ \text{(grounded second end)}$$

When a resonant slot aperture (which has little or no imaginary admittance) is present, the admittance $Y_{306}$ of stub 306 is made equal to the negative of the admittance $Y_{305}$ of stub 305: $Y_{306}=-Y_{305}$. A stub 306 having an open second end has an admittance at the L2 frequency of:

$$Y_{306}=iY_{0,306}\tan(\beta_{L2,306}l_{306})\ \text{(open second end)}$$

where $Y_{0,306}$ is the characteristic admittance, and where $\beta_{L2,306}$ is the propagation constant of the L2-band signal as the signal propagates along the length of stub 306. $\beta_{L2,306}$ can be different from βL2,305, and may be determined by the same methods used for determining $\beta_{L2,305}$. A stub 306 having a grounded second end has an admittance at the L2 frequency of:

$$Y_{306}=-iY_{0,306}\ \text{cotan}\ (\beta_{L2,306}\cdot 1_{306}).\ \text{(grounded second end)}$$

Because of the periodicity of the tangent (tan) and co-tangent (cotan) functions, the quantity "kπ" may be added or subtracted from the argument $\beta_{L2,306}1_{306}$ to these functions, where k is a positive integer. Thus, the above functions at the L2 frequency would be $$Y_{306}=iY_{0,306}\ \tan\ (\beta_{L2,306}\cdot 1_{306}\pm k\pi)\ \textit{(open second end)}$$

$$Y_{306}=-iY_{0,306}\ \text{cotan}\ (\beta_{L2,306}\cdot 1_{306}\pm k\pi).\ \textit{(grounded second end)}$$

So, once the value of $Y_{305}$ is determined, the value of $Y_{306}$ can be readily determined by the above equations. If the slot aperture 303 has a substantial non-zero imaginary admittance $\text{Im}(Y_{SLOT})$, then the above process may be modified by setting $Y_{306}=-Y_{305}-\text{Im}(Y_{SLOT})$. Methods of measuring slot admittance are well known to the waveguide art and may be transferred to this case at hand.

As a final point about the selection of stub lengths, we note that the integer values for k (when "kπ" is used in the length of stub 306) and the odd integer values for n should be kept close to or equal to 1 whenever possible, and that the even integer values of n should be kept close to or equal to 2 whenever possible. Increasing the values of n and k above these minimal values decreases the signal bandwidth of the stubs. Using the minimal values of 1 (for odd) and 2 (for even) enables the stubs to have the greatest frequency bandwidth at the L1 and L2 frequencies. But in some cases there can be technological restrictions which would prevent the selection of these minimal values. There can also be some special applications in which narrow bandwidths for the stubs are desired, and therefore values greater than 1 or 2 would be desirable.

Ranges for the Aperture Slot Lengths.

As indicated above, choosing a length for aperture slot 303 in the range between $0.95\cdot\lambda_{L2}/2$ and $1.05\cdot\lambda_{L2}/2$ provides a resonant slot with relatively low imaginary impedance at the L2 frequency. Nonetheless, in generally constructed embodiments of this invention, the length of aperture slot 303 can be between $0.74\cdot\lambda_{L2}/2$ and $1.15\cdot\lambda_{L2}/2$. Slot lengths between $0.74\cdot\lambda_{L2}/2$ and $0.95\cdot\lambda_{L2}/2$, and between $1.05\cdot\lambda_{L2}/2$ and $1.15\cdot\lambda_{L2}/2$ will have more imaginary impedance, but this can be compensated for by tuning stub 306. Any of the previously described configurations for stubs 305 and 306 (e.g., open or shorted second end) and lengths may be used.

Slot Length for Intermediate Ground Planes made from Printed Circuit Board.

As previously described, the length of slots 303 in the ground plane 301 is preferably around $\lambda_{L2}/2$. Through their work, the inventors have found a preferred range of slot lengths for the case where the ground plane is constructed from printed circuit board material (see FIGS. 4A–4C), or other similar material having a dielectric core layer. In this case, the slot length depends upon the effective dielectric constant of the so-called "slot line" which is formed by the intermediate ground plane 301, the two edges of slot 303, and the dielectric core layer. The effective dielectric constant is for signal waves that propagates perpendicular to intermediate ground plane 301, and which pass through slot 303. The effective dielectric constant for the slot line, which will be denoted herein as $\epsilon_{eff,\,S\text{-}L}$, depends upon the slot width, the thickness of the dielectric core layer, and the relative dielectric constant of the core layer. Methods for computing $\epsilon_{eff,\,S\text{-}L}$, from these parameters are well known to the art and a description thereof is not necessary in order for one of ordinary skill in the art to make and use this invention. The reader who is unfamiliar with the computation of effective dielectric constants is referred to the textbook by K. C. Gupta, et al., entitled "Computer aided design of microwave circuits," Artech House, 1981, for further information. With the effective dielectric constant $\delta_{eff,\,S\text{-}L}$ determined, then a preferred range of slot lengths is between approximately $$\frac{0.74}{\sqrt{\epsilon_{eff,S-L}}}\cdot\frac{\lambda_{L2}}{2}\ \text{and approximately}\ \frac{1.15}{\sqrt{\epsilon_{eff,S-L}}}\cdot\frac{\lambda_{L2}}{2}.$$

Each of the filter stubs 305 and 306 (such as made from layer 406) formed on the printed circuit board may have open or shorted second ends, and may have any of the previously disclosed lengths.

Exemplary Embodiments and Measurement Results.

Figure 11:
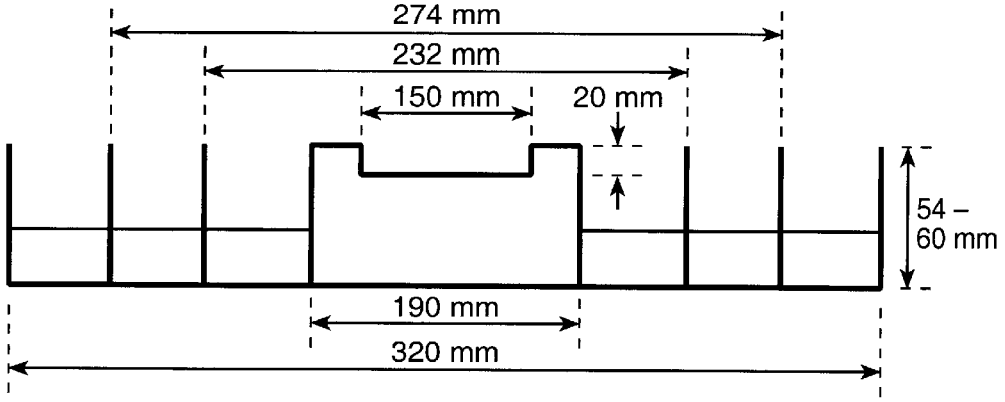
FIG. 11 shows a cross-sectional view of a single-frequency ground plane for improved multipath rejection of L2 according to the second invention.

FIG. 11 is a cross-sectional view of a single frequency ground plane according to the second invention of the present disclosure. The ground plane is suitable for dual frequency dual system use for the L1- and L2-bands of GPS and the bands for GLONASS. The ground plane has a diameter of 320 mm, with 3 grooves of having widths of between 21 mm and 23 mm (e.g., 23 mm, 21 mm, 21 mm, inside groove to outside groove.) The depth of each groove is 60 mm, but may vary between approximately 54 mm and approximately 60 mm. These groove depths are less than one-quarter wavelength of the L2-band signals (24.4 mm/4= 61.1 mm). The center part of the ground plane, where the antenna is located, is 190 mm in diameter. The antenna is put at the bottom of a cylindrical tube (a piece of circular waveguide), and is set at the distance of 20 mm from the top of the groove ends. This ground plane provides very good multipath rejection for signals in the L2 band, and comparatively good, but not optimal, multipath rejection for signals in the L1 band.

Figure 12A:
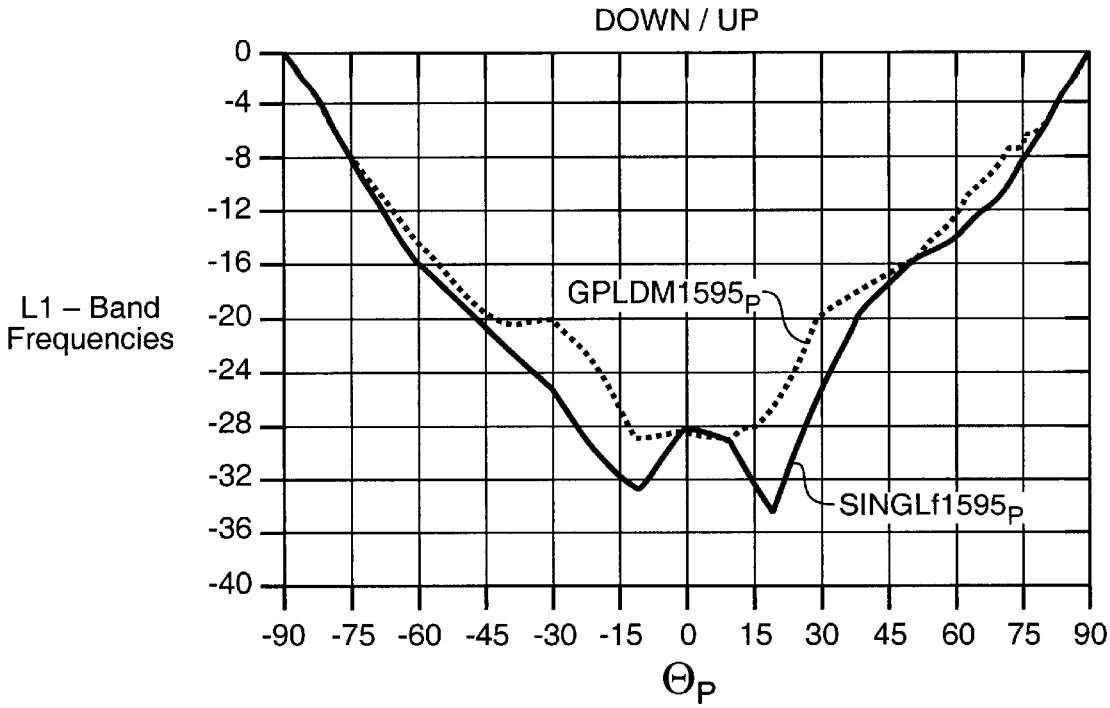
FIG. 12A shows the Down/Up ratio of single frequency ground plane within the L1 frequency band as a function of satellite angle, according to the present invention.
Figure 12B:
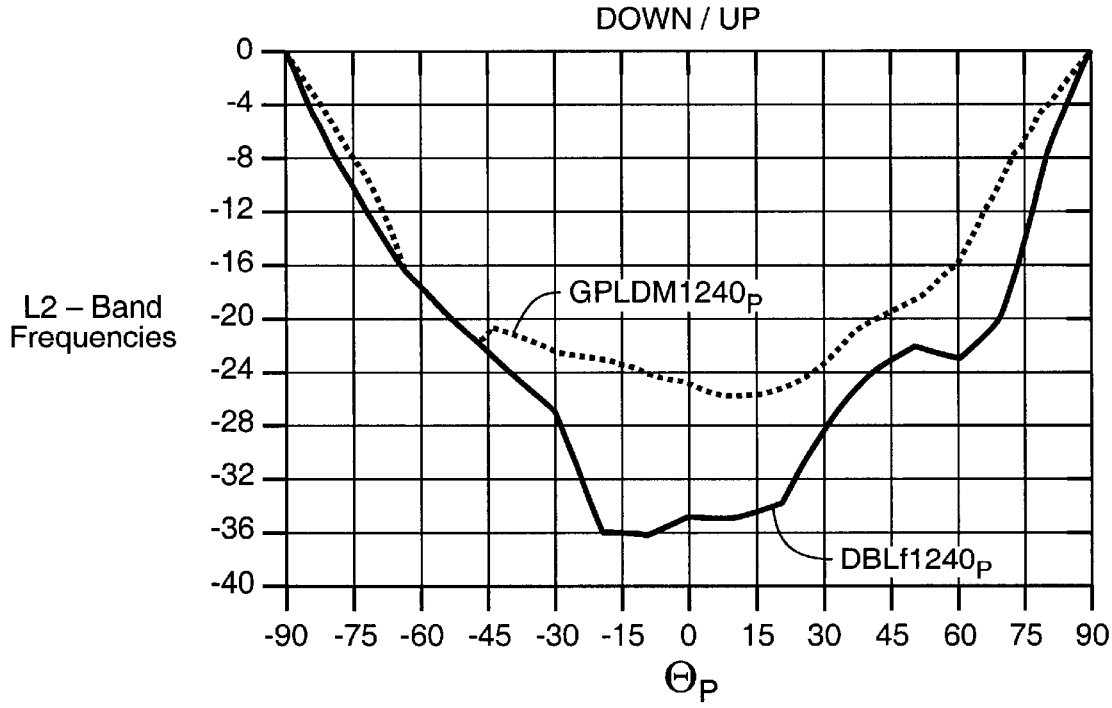
FIG. 12B shows the Down/Up ratio of single frequency ground plane within the L2 frequency band as a function of satellite angle, according to the present invention.

FIGS. 12A and 12B show charts of the Down/Up ratio of the ground plane and a prior art device as a function of the angle $\Theta_P$ between the direction from the antenna to the zenith and the direction from the antenna to the satellite. In a down/up measurement, a test signal is transmitted to the antenna from a test source, which emulates the satellite broadcast signal. The source is moved in a large circle around the antenna as the signal is being transmitted. The test circle lies in a plane that is perpendicular to the Earth's surface, and that passes through the center point of the choke-ring ground plane. The radius of the test circle is much larger than the dimensions of the ground plane. As the source is moved in the circle, the signal power received by the antenna is measured.

Test signals that are transmitted from directions above the horizontal level (also called horizon level) of the ground plane emulate the directly received signals. These test signals have angles $\Theta_P$ which range between −90° and +90°, where the source is directly over the antenna at $\Theta_P$=0, where the source is at the left-side horizon level at an angle $\Theta_P$=90°, and where the source is at the right-side horizon level at an angle $\Theta_P$=+90°. Test signals that are transmitted from directions below the horizontal level of the ground plane emulate multipath signals. These test signals have angles $\Theta_P$ which range between −90° and −180° for the left side and between +90° and +180° for the right side. The source is directly underneath the antenna at angles $\Theta_P$=−180° and $\Theta_P$=180°. (As before, the source is at the left-side horizon point at an angle of $\Theta_P$=90°, and at the right-side horizon point at an angle of $\Theta_P$=+90°. ) For the left side of the antenna, the down/up ratio is the ratio of the signal power received by the antenna at a source angle of (−180°−$\Theta_P$) divided by the signal power received by the antenna at a source angle of $\Theta_P$. For the right side of the antenna, the down/up ratio is the ratio of the signal power received by the antenna at a source angle of (180°−$\Theta_P$) divided by the signal power received by the antenna at a source angle of $\Theta_P$. It is noted that angles (−180°+$\Theta_P$) and $\Theta_P$ on the left side have equal angular distance to the horizon; likewise for angles (180°−$\Theta_P$) and $\Theta_P$ on the right side. Thus, the down/up ratio is the multipath signal power divided by the signal power of the directly received power as measured at equal angles from the horizon. A lower down/up ratio means more reduction of the multipath signal. Since the ratio is with power levels, the down/up ratio is often provided in units of dB(decibels).

As a practical matter, the down/up measurement is usually made with the test source held in a fixed position and with the antenna being rotated rather than the source being rotated. The rotational angle of the antenna in this second configuration is equal to the negative of the rotational angle of the test source in the previously-described first configuration (in other words, the angles are equal in magnitude, but opposite in sign). As a further practical matter, the test source and antenna are usually disposed so that the axis between them is horizontal rather than vertical. The first and second measurement configuration provide equivalent results. The first configuration provides one skilled in the art with the physical significance of the measured data; while the second configuration provides one skilled in the art with a simplified way of obtaining the measured data.

FIGS. 12A and 12B show the down/up ratio for the ground plane of FIG. 11 (no intermediate ground plane, no slot apertures, and no stubs) with a solid line. FIG. 12A is for L1-band frequencies, and FIG. 12B is for L2-band frequencies. It can be seen that the down/up ratio for L2 signals (FIG. 12B) is 6–8 dB lower (and therefore better) than the down/up ratio for L1 signals. For comparison, the down/up ratio of a Jet Propulsion Laboratory (JPL) choke ring using a Dorn-Margolin antenna is shown in FIGS. 12A and 12B by dotted lines.

Under ideal measurement conditions and without noise, the curves in FIGS. 12A and 12B (and all other graphs of down/up ratios) would be symmetrical (i.e., the same for left and right sides.) The asymmetry in the graphs is due to real-world test conditions where noise is present.

Figure 13:
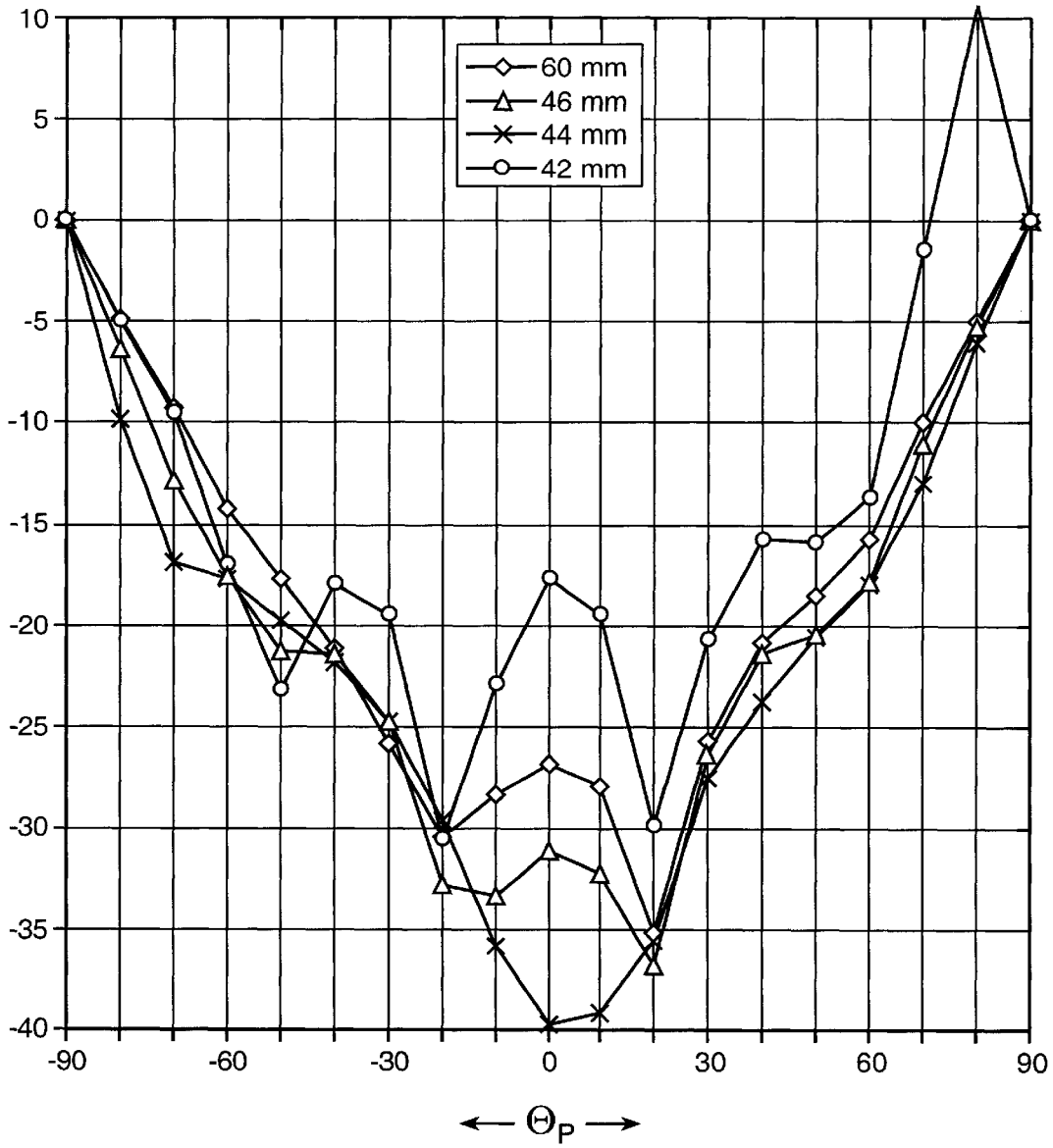
FIG. 13 shows four different Down/Up ratios at four different groove depths for a single ground plane intended for the receipt and processing of an L1 band signal, the four ratios being used to identify an optimal groove depth, according to the present invention.

FIG. 13 shows the measured Down/Up behavior of the same ground plane with the test signal frequency in the L1-band for several groove depths. It can be seen that if the depth is smaller than 42 mm, the multipath rejection becomes worse because of surface wave excitation. If the depth is bigger than 50 mm, the multipath rejection also becomes worse because of the wrong phase of the secondary wave. The optimal depth is approximately 47 mm±3 mm. This result shows that spacing tolerance between intermediate ground plane 301 and to top ends of the grooves is not too rigorous. So, the intermediate ground plane 301 may be positioned at approximately 47 mm distance from the top ends of the grooves. In this case, the distance between intermediate ground plane 301 and the groove's bottom will not be less than approximately 12 mm. Also, we note that the distance between intermediate ground plane 301 and the top ends of the grooves is less than $\lambda_{L1}/4$.

Figure 14:
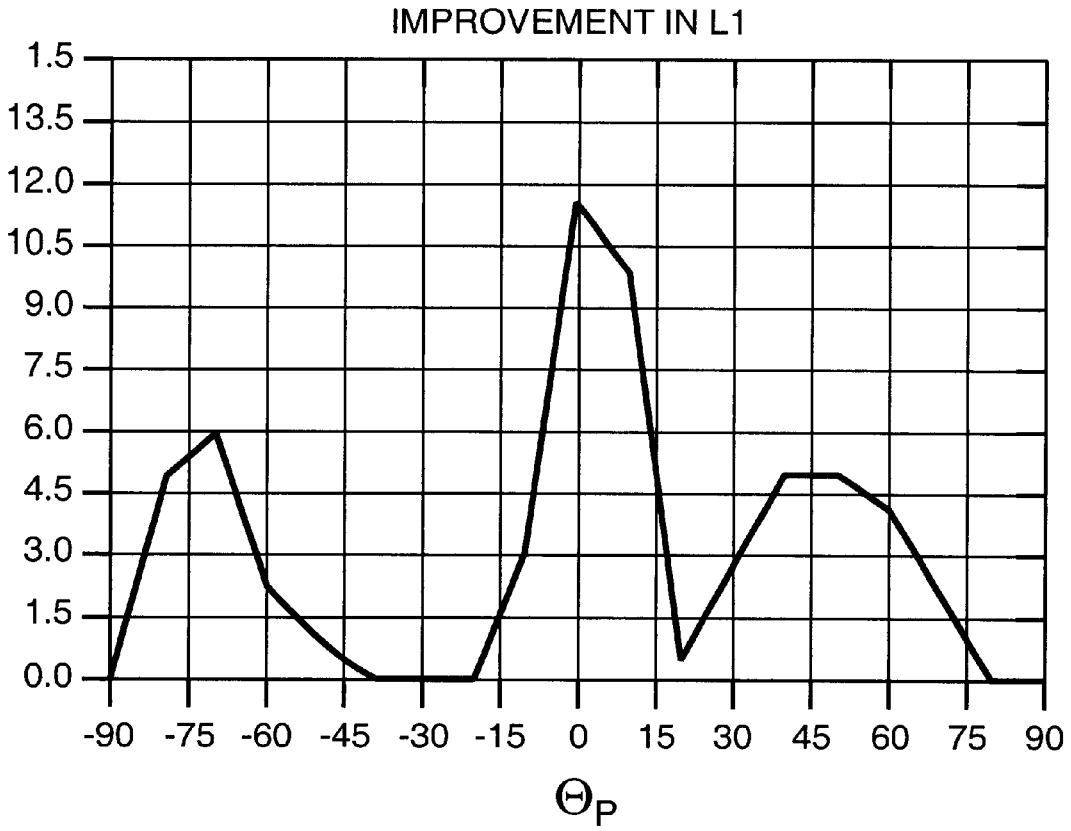
FIG. 14 shows a comparison of Down/Up ratio within L1 band between optimal and single frequency ground plane, according to the present invention.

FIG. 14 shows the difference between down/up ratios of two ground planes for an L1 signal. One ground plane is described above in the text for FIG. 11. Its groove depth is selected to provide good performance for the L2 signal (groove depth of 60 mm). Another one is of the same dimensions but has its groove depth selected to provide good performance for the L1 signal (groove depth of 47 mm). It can be seen that for some angles $\Theta_P$ the difference is 12 dB.

Figure 15A:
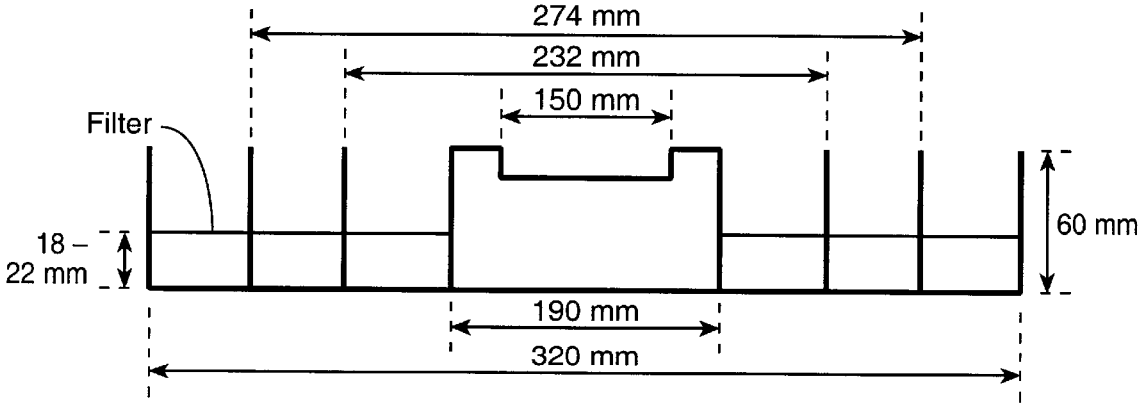
FIG. 15A shows a cross-sectional view of a first embodiment of a dual frequency ground plane for improved multipath rejection of both L1 and L2 bands, according to both the first and second inventions of the present disclosure.

FIG. 15A is a cross-sectional view of an embodiment of a dual-frequency, dual-system, ground plane with intermediate ground planes, slot apertures, and stub filters. This embodiment is suitable for implementations where one or two electromagnetic filters are used per aperture 303. Dimensions of ground plane (except the position of the intermediate ground planes) are the same as on FIG. 11. The intermediate ground planes 301 are arranged at a height of 20 mm×2 mm from the grooves bottom. The innermost groove has 6 aperture slots 303 arranged at periodic angular distances, the middle groove has 8 aperture slots 303 arranged at periodic angular distances, and the outermost groove has 10 aperture slots 303 arranged at periodic angular distances. The aperture slots have slot lengths in the range of approximately 90 mm to approximately 130 mm, and a slot width which is less than approximately 4.8 mm, preferably having a value of approximately 0.25 mm. The slot width typically varies between $0.0015\cdot\lambda_{L2}$ and $0.03\cdot\lambda_{L2}$, with preferred values being between $00015\cdot\lambda_{L2}$ and $0.01\cdot\lambda_{L2}$. Stubs 305 and 306 are formed on a dielectric board having a relative dielectric constant of $\epsilon_r$=3.2, and a thickness of 0.76 mm. The width of each stub 305 and 306 is 0.45 mm, and each has a characteristic impedance of 97 ohms. Stubs 305 have a length of approximately 30 mm and has its second end open. Stub 306 is grounded on either side of the slot aperture 303 and has a length of 9 mm.

Figure 15B:
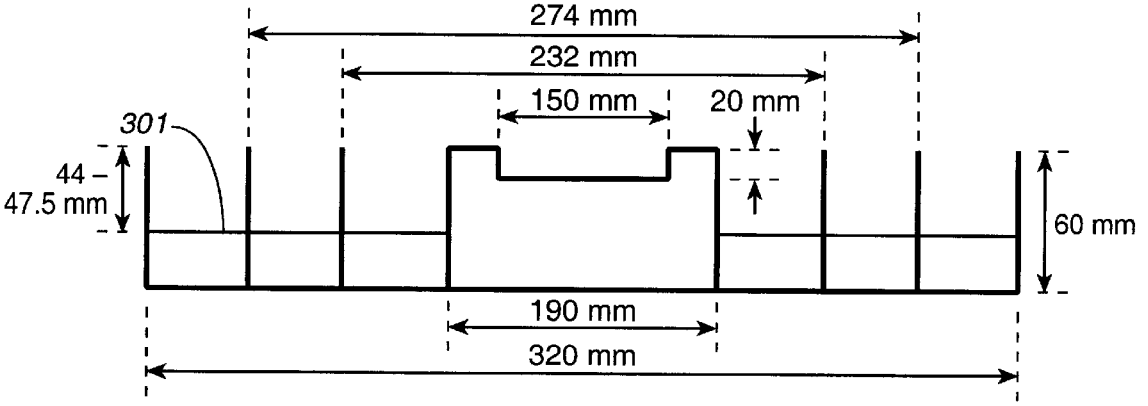
FIG. 15B shows a cross-sectional view of a second embodiment of a dual frequency ground plane for improved multipath rejection of both L1 and L2 bands, according to both the first and second inventions of the present disclosure.

FIG. 15B is a cross-sectional view of another embodiment of a dual-frequency, dual-system, ground plane with intermediate ground planes, slot apertures, and stub filters. This embodiment is suitable for implementations where several electromagnetic filters are used per aperture 303. Dimensions of the ground plane (except the position of the intermediate ground planes) are the same as in FIG. 15A. The intermediate ground planes 301 are arranged at 48 mm from the top ends of the grooves (corresponding to a height of 12 mm from the grooves bottom). In the implementations exemplified by FIG. 15B, the intermediate ground plane is spaced from the top surface of the ground plane (which is the tops of the grooves) by a distance in the range of approximately 46 mm to approximately 50 mm. In the implementations exemplified by FIG. 15A, the intermediate ground plane is spaced from the top surface of the ground plane by a distance in the range of approximately 38 mm to approximately 42 mm. Thus, depending upon the number of filters per slot, the intermediate ground plane spaced from the top surface of the ground plane (or the tops of the grooves) by a distance in the range of approximately 38 mm ($\sim_{L1}/5$) to approximately 50 mm ($\sim\lambda_{L1}/4$).

Figure 16A:
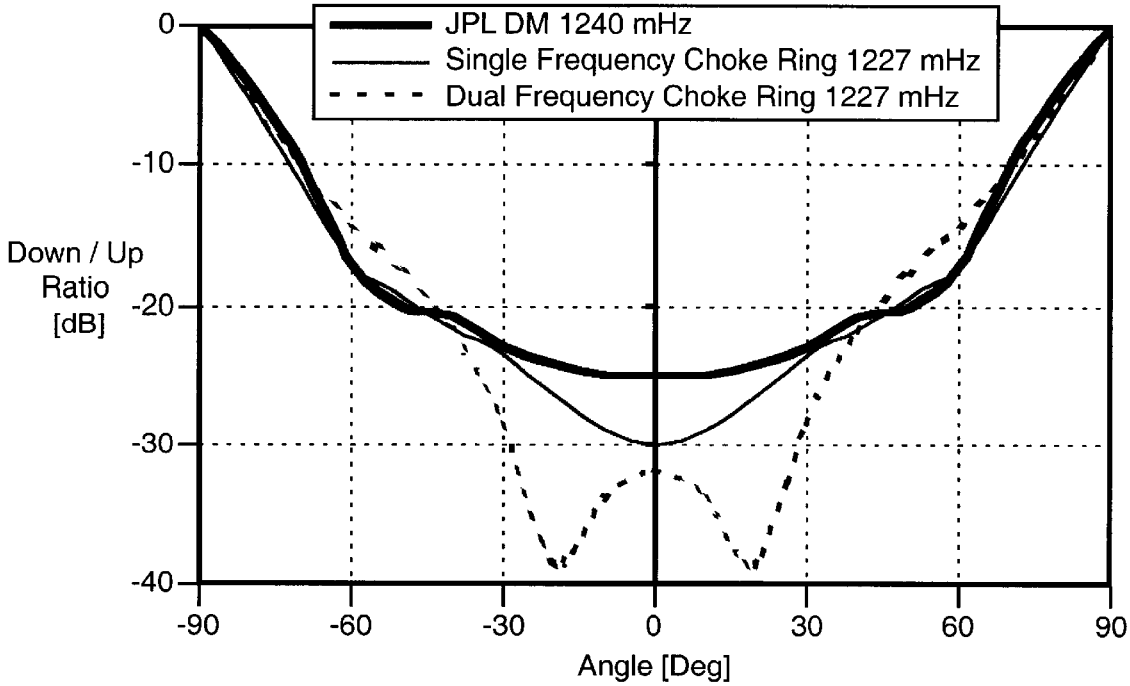
FIGS. 16A–16D show the measured Down/Up ratio for a dual depth dual frequency choke ring that was made by inventors versus the ratio for a JPL choke ring having a Dorn-Margolin antenna, and further versus the ratio for a single frequency choke ring tuned for optimal performance in the L2 band.
Figure 16B:
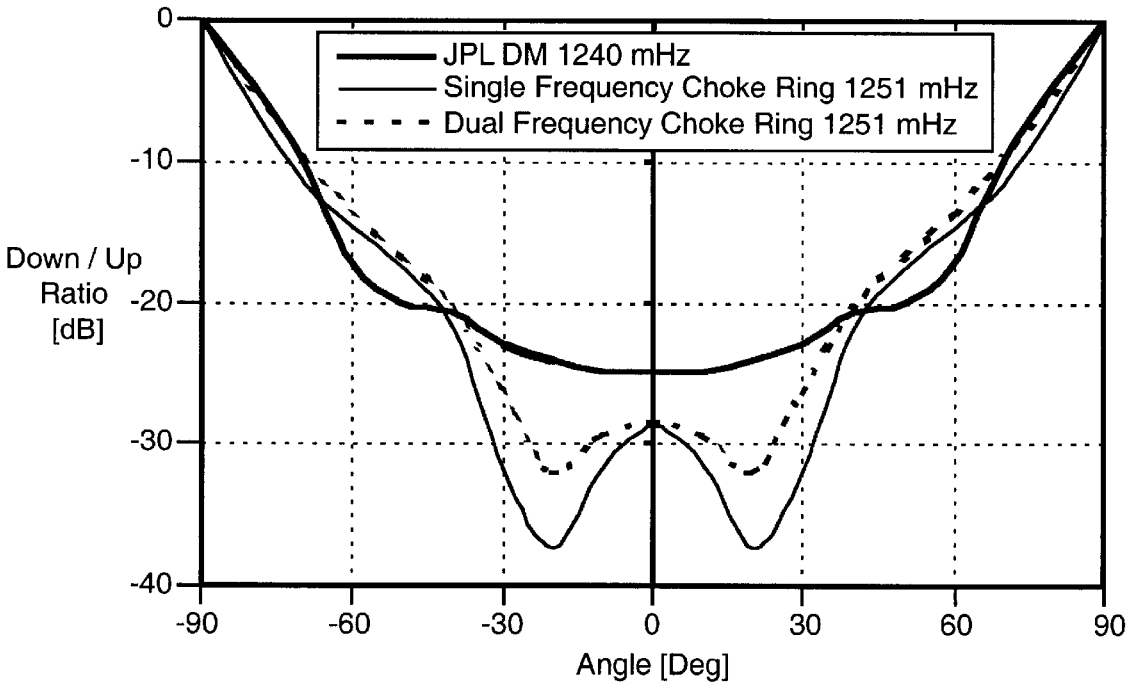
Figure 16C:
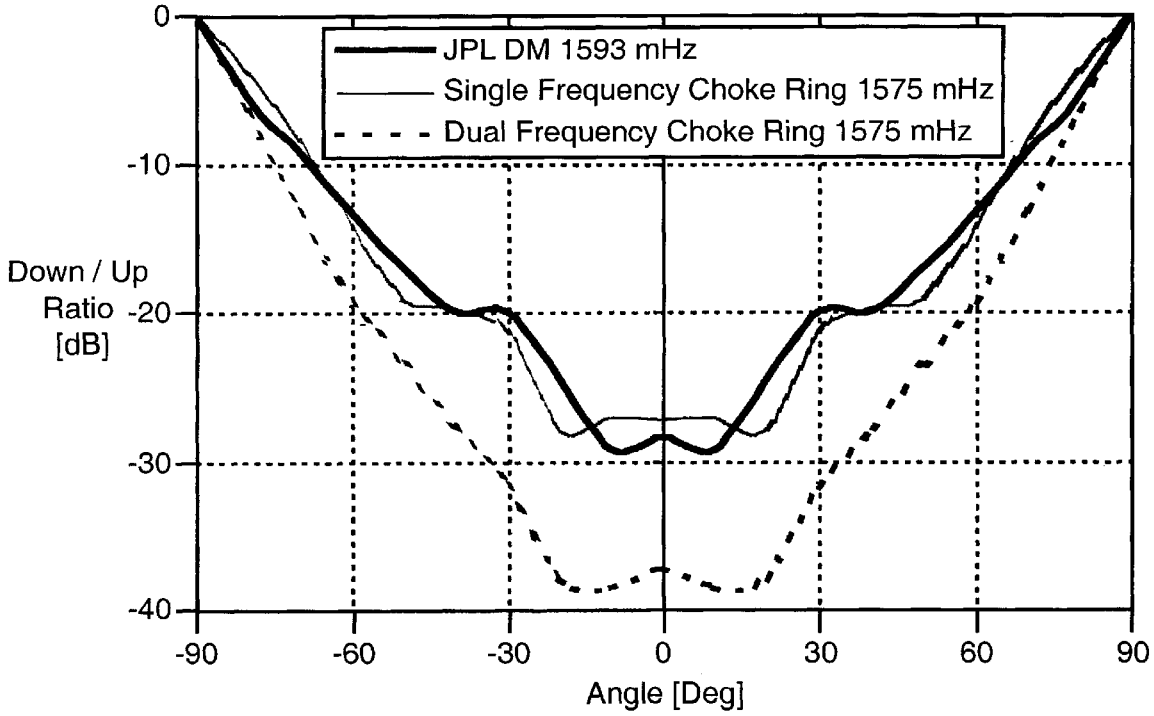
Figure 16D:
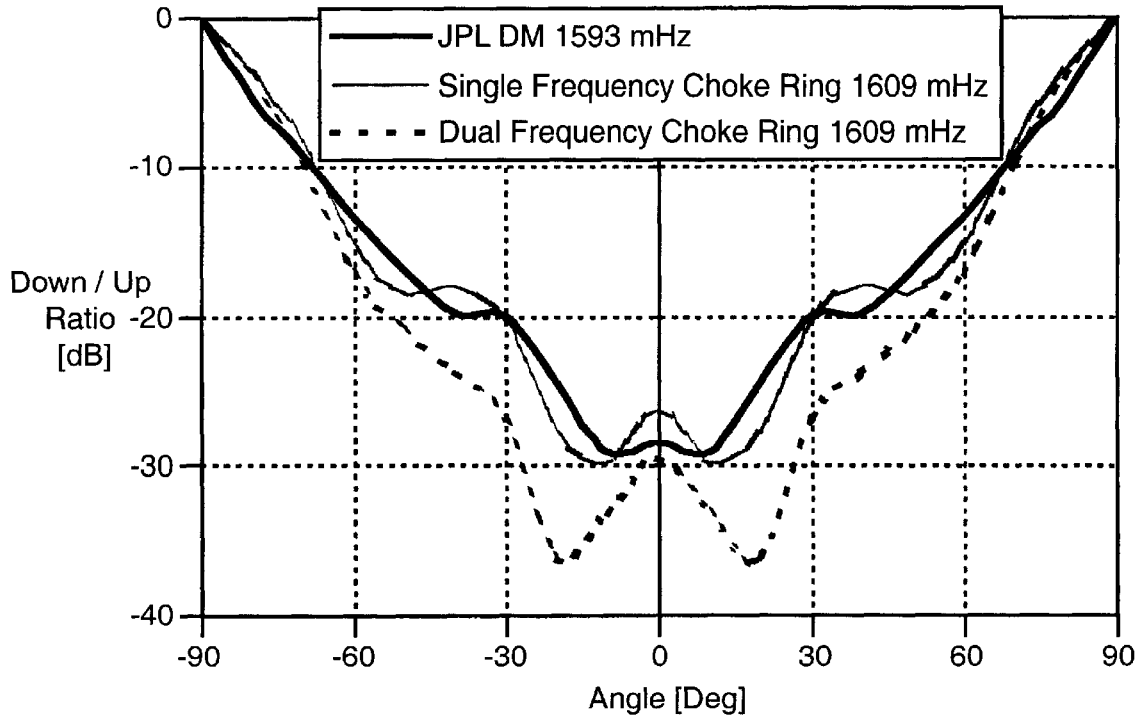

FIG. 16A through FIG. 16D show the measured Down/Up ratio for a dual depth dual frequency choke ring that was made by inventors (according to FIG. 15A) versus the ratio for a JPL choke ring having a Dorn-Margolin antenna, and further versus the ratio for a single frequency choke ring tuned for optimal performance in the L2 band. FIGS. 16A and 16C are done using GPS frequencies in the L2 and L1 bands, respectively, and FIGS. 16B and 16B are done using GLONAS (GLN) frequencies in the L2 and L1 bands, respectively. As can be seen in the figures, the dual frequency choke ring operates on GPS and GLONAS frequencies both in L1 and L2 band, and has better performance than the JPL choke ring. In order to remove noise measured data was smoothed. Single Slot embodiments and further modifications.

From the discussion presented above, it may be appreciated that the plurality of slots apertures 303 in an intermediate ground plane 301 may be formed using a single slot aperture 303 which goes a full circle around the center point (or nearly a full circle), and that stubs which short at the L2 frequency may be placed at equal angular intervals along the single slot to effectively create a plurality of slot apertures 303 from a single physical aperture. Additional stubs which short at the L1 frequency may be placed next to the stubs which short at L2. These shorting stubs would be different from the stubs 305,306 which are used to provide blocking of the L1 frequency signals, as described above.

While it is preferred that an intermediate ground plane 301 is used in each groove of the exemplary embodiments of this invention, it may be appreciated that some grooves may not have intermediate ground planes. In addition, additional apertures which do not have corresponding electromagnetic filters may be added to an intermediate ground plane, particularly those apertures which have such small size that they do not allow significant transmission of the L1 or L2 band signals through their openings.

Methods of Construction of the Choke-Ring Housing.

Some conventional choke rings are usually machined by a lathe from a solid thick ring or metal. This is quite expensive in both materials cost and labor costs because of the material removed to cut the grooves and of the time required to perform the cutting. As a less expensive option, the ring may be pre-cast in a course form, and then machined by lathe to the final dimensions. This provides considerable cost savings.

As yet a third invention of this disclosure, new methods of forming choke-ring ground plane are disclosed, which may be used to construct prior art ground plane or ground planes according to any of the preceding inventions disclosed herein. According to this invention, the choke-ring ground plane is formed from a dielectric material, and more preferably from a moldable plastic or polymer material. Preferably, the choke-ring ground plane is formed by injection molding of flowable plastic material into a mold. The plastic material may be thermosetting material or thermoplastic material. After molding, burrs are removed and a thin conductive layer is formed over the plastic body. The thin conductive material may be formed by any number of electroless plating techniques that are known to the art. In constructed embodiments of this invention, a conventional electroless plating method is used. The thin metal layer may also be formed by spray-painting or dip-coating the plastic body with a conductive paint. Also, techniques are known for chemically applying a conductive layer to plastic and other polymers, and thereafter plating any number of metals onto the initial conductive layer. The plastic body can be readily formed to precise tolerances with known plastic injection molding techniques. In general, choke-ring ground planes for global positioning applications have diameters of at least 200 mm and thicknesses of at least 38 mm, and usually have thicknesses of less than 70 mm. Additionally, the injection mold for the dielectric body may be designed so as to form a ledge on one or both side walls of each groove, with the ledge(s) being used to position an intermediate ground plane within the groove, if an intermediate ground plane is to be used. In this case, the intermediate ground plane seats against the ledge(s). The ledge may be formed by making the bottom portion of the groove wall slightly thicker than the top portion, in order to facilitate release from the mold. In place of ledges, or in conjunction with ledges, tabs may also be formed at several locations on the one or both of the groove's walls for the purpose of receiving and seating an intermediate ground plane. The dual-frequency, choke-ring ground planes according to the present invention may also be formed in two piece sections, with the top section having the intermediate ground planes and the upper portions of the groove, and the bottom section have the bottoms and lower portions of the grooves.

While the present inventions have been particularly described with respect to their respective illustrated embodiments, it will be appreciated that various alterations, modifications and adaptations may be made based on the present disclosure, and are intended to be within the scopes of the present inventions. While the inventions has been described in connection with what is presently considered to be the most practical and preferred embodiments thereof, it is to be understood that the present inventions are not limited to the disclosed embodiments but, on the contrary, are intended to cover various modifications and equivalent arrangements included within the scope of the appended claims.

APPENDIX

Evaluation of expressions for Y and M.

In order to obtain slot voltage at point where stubs are arranged let us use Poynting theorem. As it follows from said theorem, power flow through slot is the same on both sides of it.

$$\int_{S1} [E_{Sl}, H^*_{T1}]ds = -\int_{S2} [E_{Sl}, H^*_{T2}]ds \tag{A1}$$

or $$\int_{S1} [E_{Sl}, (H^*_{T1} - H^*_{T2})]ds = 0 \tag{A2}$$

where $S_1$ and $S_2$ are the slot surfaces in space domains 1 and 2 (see FIG. [18]9), $E_{Sl}$ is the electrical field in the slot, and $H_{T1}$ and $H_{T2}$ are the tangential components of magnetic field at each surface $S_1$ and $S_2$ of the slot, respectively. The notation [A,B] denotes the vector cross-product, also called vector multiplication product, of vectors A and B. Let us set $E_{Sl}$ as follows:

$$E_{Sl}=U/d\cdot\psi(r,\phi) \tag{A3}$$

where U is the voltage between slot edges at the point where the stubs are arranged, $\psi(r,\phi)$ is the vector function of E-field distribution along the slot, and d is the slot width. At the first surface $S_1$, the tangential magnetic field $H_{T1}$ is sum of two fields: a standing wave $H_{T1,SV}$ and a slot field $H_{T1,SL}$:

$$H_{T1}=H_{T1,SV}+H_{T1,SL}. \tag{A4}$$

At the second surface $S_2$, the $H_{T2}$ is only the slot field $$H_{T2}=H_{T1,SL} \tag{A5}$$

With the use of equations (A4), (A5) in equations (A1),(A2) it is possible to evaluate:

$$2\cdot U^*\cdot\int_{S1} [\psi, H^*_{T1,Sl}(1)]ds = -\int_{S2} [\psi, H^*_{T1,SV}]ds \tag{A6}$$

where $H^*_{T1,Sl}(1)$ is the tangential component of the slot field when voltage U is equal to 1. This component can be calculated with the use of partial (Floquett) waveguide eigenwaves. Let us denote:

$$Y = \int_{S1} [\psi^*, H_{T1,S1}(1)] ds \quad \text{(A7)}$$

$$M = -\int_{S2} [\psi^*, H_{T1,SV}] ds \quad \text{(A8)}$$

Combining (A6 )–(A8) and taking conjugate quantities one will obtain equation (14) in the main part of the text.

What is claimed is:

1. A choke ring ground plane for an antenna, said ground plane comprising:

a circular-shaped body having a top surface, a bottom surface, a thickness between said top and bottom surfaces, said top surface having periphery and a center point at the center of said top surface;

a plurality of concentric grooves formed in the top surface of said circular-shaped body, said grooves being centered about said center point;

an intermediate ground plane located in one of said grooves, said intermediate ground plane being parallel to said top surface;

at least one aperture formed in said intermediate ground plane, and at least one electromagnetic filter disposed at each said aperture.

2. The ground plane of claim 1 wherein a plurality of electromagnetic filters are disposed at each said aperture.

3. The ground plane of claim 1 further comprising a plurality of additional intermediate ground planes, each said intermediate ground plane being located in a respective one of said grooves, and being parallel to the top surface.

4. The ground plane of claim 3 wherein each said intermediate ground plane has a plurality of apertures formed through it, said apertures being spaced from one another at equal angular intervals about said center point.

5. The ground plane of claim 4 wherein a first one of said grooves is closer to the center point than a second one of said grooves, and wherein the second one of said grooves has more apertures formed through it than the first one of said grooves.

6. The ground plane of claim 3 wherein said intermediate ground plane has a plurality of apertures formed through it, said apertures being spaced from one another at equal angular intervals about said center point.

7. The ground plane of claim 1 wherein said intermediate ground plane is spaced from said top surface by a distance in the range of approximately 38 mm to approximately 50 mm.

8. The ground plane of claim 1 wherein said ground plane is for receiving signals at a first frequency having a first wavelength $\lambda_1$ and signals at a second frequency having a second wavelength λ2, said first wavelength A being shorter than said second wavelength $\lambda_2$, wherein said intermediate ground plane is spaced from said top surface by a distance in the range of one-fifth of $\lambda_1$ to one-fourth of $\lambda_1$.

9. The ground plane of claim 1 wherein said intermediate ground plane is spaced from said top surface by a distance in the range of approximately 38 mm to approximately 42 mm.

10. The ground plane of claim 1 wherein said ground plane is for receiving signals at a first frequency having a first wavelength $\lambda_1$ and signals at a second frequency having a second wavelength $\lambda_2$, said first wavelength $\lambda_1$ being shorter than said second wavelength $\lambda_2$, wherein said intermediate ground plane is spaced from said top surface by a distance in the range of $7/32 \cdot \lambda_1$ to $15/76 \cdot \lambda_1$.

11. The ground plane of claim 1 wherein said intermediate ground plane is spaced from said top surface by a distance in the range of approximately 46 mm to approximately 50 mm.

12. The ground plane of claim 1 wherein said ground plane is for receiving signals at a first frequency having a first wavelength $\lambda_1$ and signals at a second frequency having a second wavelength $\lambda_2$, said first wavelength $\lambda_1$ being shorter than said second wavelength $\lambda_2$, wherein said intermediate ground plane is spaced from said top surface by a distance in the range of $0.95 \cdot \lambda_1/4$ to $1.05 \cdot \lambda_1/4$.

13. The ground plane of claim 1 wherein said aperture comprises a slot having a length in the range of between approximately 90 mm to approximately 130 mm, and a slot width of less than 4.8 mm.

14. The ground plane of claim 1 wherein said ground plane is for receiving signals at a first frequency having a first wavelength $\lambda_1$ and signals at a second frequency having a second wavelength $\lambda_2$, said first wavelength $\lambda_1$ being shorter than said second wavelength $\lambda_2$;

wherein said aperture comprises a slot, wherein dielectric material is disposed next to said slot such that said slot has an effective relative dielectric constant $\epsilon_{eff,\ S\text{-}L}$ which is different from unity, and wherein the slot has a length of between $$\frac{0.74}{\sqrt{\epsilon_{eff,S-L}}} \cdot \frac{\lambda_2}{2} \text{ and } \frac{1.15}{\sqrt{\epsilon_{eff,S-L}}} \cdot \frac{\lambda_2}{2}.$$

15. The ground plane of claim 1 wherein said ground plane is for receiving signals at a first frequency having a first wavelength $\lambda_1$ and signals at a second frequency having a second wavelength $\lambda_2$, said first wavelength $\lambda_1$ being shorter than said second wavelength $\lambda_2$, and wherein the slot has a length of between $0.74 \cdot \lambda_2/2$ and $1.15 \cdot \lambda_2/2$.

16. The ground plane of claim 1 wherein said electromagnetic filter comprises a first conductive stub crossing said aperture, said first conductive stub having at least one of its ends grounded to said intermediate ground plane.

17. The ground plane of claim 16 wherein said electromagnetic filter further comprises a second conductive stub crossing said aperture, said second conductive stub having at least one of its ends grounded to said intermediate ground plane.

18. The ground plane of claim 16 wherein said first conductive stub comprises an electrical trace formed on a dielectric board.

19. The ground plane of claim 16 wherein said first conductive stub comprises a wire suspended in air.

20. The ground plane of claim 16 wherein said intermediate ground plane comprises a dielectric board having an annular-ring shape, a conductive layer disposed on a first side of said dielectric board, and an aperture formed in said conductive layer, wherein said first conductive stub comprises a conductive trace formed on the second side of said dielectric board and a conductive through-hole between said conductive trace and said conductive layer on said first side, and wherein a portion of said conductive trace overlies the aperture formed in said conductive layer.

21. The ground plane of claim 17 wherein said ground plane is for receiving signals at a first frequency having a first wavelength $\lambda_1$ and signals at a second frequency having a second wavelength $\lambda_2$, said first wavelength $\lambda_1$ being shorter than said second wavelength $\lambda_2$, said first conductive stub, second conductive stub, and said aperture blocking the transmission of the signals at the first frequency through said aperture to a greater degree than the signals at the second frequency.

22. The ground plane of claim 21 wherein a signal at the first frequency has an in-line wavelength of $\lambda'_1$ when it propagates along the length of said first stub, wherein one end of said first stub is open, and wherein the length of said first stub is within $\pm 0.1\cdot\lambda_1/4$ of the quantity: $\lambda'_1(2n+1)/4$, where n is any integer number from 0 to infinity.

23. The ground plane of claim 22 wherein said aperture comprises a slot having a length in the range of $0.95\cdot\lambda_2/2$ and $1.05\cdot\lambda_2/2$.

24. The ground plane of claim 22 wherein said aperture comprises a slot, wherein dielectric material is disposed next to said slot such that said slot has an effective relative dielectric constant $\delta_{eff,S-L}$ which is different from unity, and wherein the slot has a length of between $$\frac{0.74}{\sqrt{\epsilon_{eff,S-L}}}\cdot\frac{\lambda_2}{2} \text{ and } \frac{1.15}{\sqrt{\epsilon_{eff,S-L}}}\cdot\frac{\lambda_2}{2}.$$

25. The ground plane of claim 21 wherein the length of said first stub is between $0.9\cdot\lambda'_1/4$ and $1.1\cdot\lambda'_1/4$.

26. The ground plane of claim 21 wherein a signal at said first frequency has an in-line wavelength of $\lambda'_1$ when it propagates along the length of said first stub, wherein said first conductive stub has both of its ends grounded to said intermediate ground plane, and wherein the length of said first stub is within $\pm 0.1\cdot\lambda'_1/2$ of the quantity: $\lambda'_1\cdot n/2$, where n is any integer number from 1 to infinity.

27. The ground plane of claim 26 wherein the length of said first stub is between $0.9\cdot\lambda'_1/2$ and $1.1\cdot\lambda'_1/2$.

28. The ground plane of claim 26 wherein said aperture comprises a slot having a length in the range of $0.95\cdot\lambda_2/2$ and $1.05\cdot\lambda_2/2$.

29. The ground plane of claim 26 wherein said aperture comprises a slot, wherein dielectric material is disposed next to said slot such that said slot has an effective relative dielectric constant $\epsilon_{eff,\ S-L}$ which is different from unity, and wherein the slot has a length of between $$\frac{0.74}{\sqrt{\epsilon_{eff,S-L}}}\cdot\frac{\lambda_2}{2} \text{ and } \frac{1.15}{\sqrt{\epsilon_{eff,S-L}}}\cdot\frac{\lambda_2}{2}.$$

30. The ground plane of claim 21 wherein the depth of each groove is between approximately $0.88\cdot\lambda_2/4$ and approximately $0.98\cdot\lambda_2/4$.

31. The ground plane of claim 21 wherein the depth of each groove is between approximately $0.92\cdot\lambda_2/4$ and approximately $0.97\cdot\lambda_2/4$.

32. The ground plane of claim 1 wherein said ground plane is for receiving signals at a first frequency having a first wavelength $\lambda_1$ and signals at a second frequency having a second wavelength $\lambda_2$, said second wavelength $\lambda_2$ being greater than said first wavelength $\lambda_1$.

wherein the groove in which the intermediate ground plane is located has an inner side wall and an outer side wall, wherein the radial distance from said center point to the inner side wall is $r_{min}$ and the distance from said center point to the outer side wall is $r_{max}$, and wherein said choke ring ground plane comprises at least $2\lambda(r_{min}+r_{max})/\lambda_2+1$ apertures in said intermediate ground plane.

33. The ground plane of claim 1 wherein said aperture comprises a slot have a first end portion, a central portion, and a second end portion, wherein said central portion has an arc shape and is disposed on a radius of said center point, and wherein said end portions are bent with respect to said central portion.

34. The ground plane of claim 33 wherein said end portions are bent inward toward said center point and contact a groove wall.

35. The ground plane of claim 33 wherein said end portions are bent outward away from said center point and contact a groove wall.

36. The ground plane of claim I wherein said ground plane comprises three concentric grooves and three intermediate ground planes, each intermediate ground plane being disposed in a corresponding one of said grooves and being parallel to said top surface, said three concentric grooves being adjacent to one another so that there is an innermost groove, a middle groove, and an outermost groove, said ground plane further comprising six apertures formed in the intermediate ground plane which is disposed in the innermost groove, eight apertures formed in the intermediate ground plane which is disposed in the middle groove, and ten apertures formed in the intermediate ground plane which is disposed in the outermost groove.

37. A choke ring ground plane for an antenna, said antenna for receiving a broadcast signal having a wavelength $\lambda$, said choke ring ground plane comprising:

a circular-shaped body having a top surface, a bottom surface, a thickness between said top and bottom surfaces, said top surface having periphery and a center point at the center of said top surface and a central portion disposed at said center point for receiving the antenna; and a plurality of concentric grooves formed in the top surface of said circular-shaped body, wherein said grooves are centered about said center point and encircling the central portion for receiving the antenna, and wherein each groove has a depth which is between approximately $0.88\cdot\lambda/4$ and approximately $0.98\cdot\lambda/4$ of the broadcast signal such that the signal magnitude at the antenna for multipath versions of the broadcast signal are reduced in value.

38. The ground plane of claim 37 wherein the depth of each groove is between approximately $0.92\cdot\lambda/4$ and approximately $0.97\cdot\lambda/4$.

39. The ground plane of claim 37 wherein the broadcast signal comprises a global positioning signal with a wavelength of 24.4 cm.

40. The ground plane of claim 39 wherein the depth of each groove is between approximately 54 mm and approximately 60 mm.

41. The ground plane of claim 40 wherein the width of each groove is between approximately 20 mm and 24 mm.

42. The ground plane of claim 40 wherein the width of each groove is between approximately 21 mm and 23 mm.

43. The ground plane of claim 37 wherein the broadcast signal comprises a global positioning signal with a wavelength of 19 cm, and wherein the depth of each groove is between approximately 41.5 mm and approximately 46.5 mm.

44. The ground plane of claim 43 wherein the width of each groove is between approximately 20 mm and 24 mm.

45. The ground plane of claim 37 comprising at least three said grooves.

46. The ground plane of claim 37 wherein one of said grooves has an inner diameter which is smaller than the inner diameters of the other grooves and which has a value of approximately 190 mm.

47. The ground plane of claim 46 wherein the central portion for receiving the antenna is recessed from said top surface of the body by an amount which is in the range from approximately 20 mm to approximately 27 mm.

48. The ground plane of claim 37 wherein the plurality of grooves are referenced by an identifying index designated herein as index "K", wherein each K-th groove has an inner side wall and an outer side wall, wherein the radial distance from said center point to the inner side wall is $R_{I,K}$ and the distance from said center point to the outer side wall is $R_{O,K}$ wherein the K-th groove has a corresponding radial width $W_K=R_{O,K}-R_{I,K}$ and an average circumferential length $L_K=2\pi(R_{O,K}+R_{I,K})/2$;

wherein the width WK of each groove is less than the wavelength $\lambda$ of the broadcast signal, and wherein the length $L_K$ of each groove is greater than the wavelength $\lambda$ of the broadcast signal.

49. A method of manufacturing a choke-ring ground plane comprising the steps of:

(a) forming a dielectric body in the shape of the choke-ring ground plane having a plurality of grooves, and (b) forming a thin layer of conductive material over the surfaces of said dielectric body.

50. The method of claim 49 wherein said dielectric body comprises a polymeric material, and wherein said step (a) comprising the step of injecting said polymeric material into a mold under pressure.

51. The method of claim 50 wherein said dielectric comprises a thermosetting polymeric material.

52. The method of claim 49 wherein said step (b) comprises the step of electroless plating a metal onto said dielectric body.

53. The method of claim 49 wherein said step (b) comprises the step of painting a conductive material onto said dielectric body.

54. The method of claim 49 wherein said step (b) comprises the step of dip-coating said dielectric body in a bath of conductive paint.

55. A choke ring ground plane comprising:

a dielectric body having a circular top surface having a diameter of at least 200 mm, a circular bottom surface, a thickness between the top and bottom surfaces, a plurality of grooves formed in said top surface of said dielectric body; and a layer of conductive material formed over the surfaces of the grooved dielectric body.

56. The choke ring ground plane of claim 55 wherein said dielectric body comprises a polymeric material.

57. The choke ring ground plane of claim 55 wherein said polymeric material comprises a plastic.

58. The choke ring ground plane of claim 55 wherein the thickness is of at least 38 mm in value.

59. The choke ring ground plane of claim 55 wherein the thickness is of at least 42 mm in value.

60. The choke ring ground plane of claim 55 wherein said dielectric body further comprises a recessed central portion disposed on the body's top surface for receiving an antenna.

61. The choke ring ground plane of claim 55 wherein the grooves have respective depths, and where the groove depths are equal.

62. A choke ring ground plane for an antenna, said antenna for receiving a broadcast signal having a wavelength $\lambda$, said choke ring ground plane comprising:

a circular-shaped body having a top surface, a bottom surface, a thickness between said top and bottom surfaces, said top surface having periphery and a center point at the center of said top surface; and a plurality of concentric grooves formed in the top surface of said circular-shaped body, wherein each groove has a depth which is between approximately $0.88\cdot\lambda/4$ and approximately $0.98\cdot\lambda/4$ of the wavelength $\lambda$ of the broadcast signal.

63. The ground plane of claim 62 wherein the depth of each groove is between approximately $0.92\cdot\lambda/4$ and approximately $0.97\cdot\lambda/4$.

64. The ground plane of claim 62 wherein the width of each groove is between approximately 20 mm and 24 mm.

65. The ground plane of claim 62 wherein one of said grooves has an inner diameter which is smaller than the inner diameters of the other grooves and which has a value of approximately 190 mm.

* * * * *